US007669989B2

(12) United States Patent
Oshio et al.

(10) Patent No.: US 7,669,989 B2
(45) Date of Patent: Mar. 2, 2010

(54) LIQUID APPLICATION DEVICE AND INKJET RECORDING APPARATUS

(75) Inventors: Naomi Oshio, Kawasaki (JP); Naoji Otsuka, Yokohama (JP); Osamu Iwasaki, Tokyo (JP); Yoshinori Nakagawa, Kawasaki (JP); Atsuhiko Masuyama, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 718 days.

(21) Appl. No.: 11/502,419

(22) Filed: Aug. 11, 2006

(65) Prior Publication Data

US 2007/0035592 A1 Feb. 15, 2007

(30) Foreign Application Priority Data

Aug. 15, 2005 (JP) ..... 2005-235403

(51) Int. Cl.
*B41J 2/175* (2006.01)

(52) U.S. Cl. ..... 347/84

(58) Field of Classification Search ..... 347/84, 347/85, 103
See application file for complete search history.

(56) References Cited

U.S. PATENT DOCUMENTS 5,367,982 A * 11/1994 DeMoore et al. ..... 118/46
5,850,233 A 12/1998 Otsuka et al. ..... 346/136
6,142,600 A 11/2000 Takahashi et al. ..... 347/23
2005/0174380 A1 8/2005 Ide et al. ..... 347/19
2005/0179720 A1 8/2005 Iwasaki et al. ..... 347/19
2006/0176325 A1 8/2006 Seki et al. ..... 347/7
2007/0034102 A1 2/2007 Oshio et al. ..... 101/348
2007/0034152 A1 2/2007 Nakagawa et al. ..... 118/679
2007/0035593 A1 2/2007 Iwasaki et al. ..... 347/85
2007/0070163 A1 3/2007 Masuyama et al. ..... 347/104
2007/0126835 A1 6/2007 Oshio et al. ..... 347/103
2007/0126836 A1 6/2007 Masuyama et al. ..... 347/103

FOREIGN PATENT DOCUMENTS

JP 8-58069 3/1996
JP 8-72227 3/1996
JP 2001-70858 3/2001
JP 2002-517341 6/2002

* cited by examiner

*Primary Examiner*—An H Do
(74) *Attorney, Agent, or Firm*—Fitzpatrick, Cella, Harper & Scinto

(57) ABSTRACT

A liquid application device and an inkjet recording apparatus are capable of reducing nonuniformity in application of liquid onto a recording medium, and thereby forming high-quality images on a steady basis. In the present invention, information indicating the lapse of time after the previous circulation operation is obtained. Subsequently, based on the obtained information indicating the lapse of time, a preliminary circulation sequence is determined. Finally, the preliminary circulation sequence is performed based on the determined preliminary circulation sequence.

9 Claims, 28 Drawing Sheets

| | | |
|---|---|---|
| LAPSE OF TIME | $P_1$ | SEQUENCE A |
| | $P_2$ | SEQUENCE B |
| | $P_3$ | SEQUENCE C |
| | $P_4$ | SEQUENCE D |
| | $P_5$ | SEQUENCE E |
| | $P_6$ | SEQUENCE F |

FIG.15

| | |
|---|---|
| SEQUENCE A | PUMP ROTATION SPEED V1 AND ROTATION PERIOD T1 |
| SEQUENCE B | PUMP ROTATION SPEED V2 AND ROTATION PERIOD T2 |
| SEQUENCE C | PUMP ROTATION SPEED V3 AND ROTATION PERIOD T3 |
| SEQUENCE D | PUMP ROTATION SPEED V4 AND ROTATION PERIOD T4 |
| SEQUENCE E | PUMP ROTATION SPEED V5 AND ROTATION PERIOD T5 |
| SEQUENCE F | PUMP ROTATION SPEED V6 AND ROTATION PERIOD T6 |

FIG.16

| | | TABLE 1: LIQUID FILLED | TABLE 2: LIQUID NOT FILLED |
|---|---|---|---|
| LAPSE OF TIME | $P_{11}$ | SEQUENCE A | SEQUENCE D |
| | $P_{12}$ | SEQUENCE B | SEQUENCE E |
| | $P_{13}$ | SEQUENCE C | SEQUENCE F |

FIG.18

LIQUID APPLICATION DEVICE AND INKJET RECORDING APPARATUS

BACKGROUND OF THE INVENTION

1. Field of the Invention

The present invention relates to a liquid application device and an inkjet recording apparatus, and particularly to a liquid application device for applying liquid to a medium for a certain purpose which is, for example, to promote the coagulation of pigment when recording is carried out using an ink which contains the pigment as a coloring material. The present invention also relates particularly to an inkjet recording apparatus which includes a mechanism for applying liquid to a recording medium used in inkjet recording, for a purpose which is, for example, to promote the coagulation of pigment when recording is carried out using an ink containing the pigment as a coloring material.

2. Description of the Related Art

As modes of widely applying liquid or liquid material to a medium, spin coaters, roll coaters, bar coaters, and die coaters are known. These application modes are adopted on the assumption that the application is consecutively performed to a relatively long application medium. As a result, when application media with a relatively small size are intermittently fed, and the application is performed to these media, the problem can occur that a uniform coating film cannot be obtained due to the irregularities of beads of coating material at the start or the end point of the application, for example.

As a configuration capable of solving such a problem, one which is described in Japanese Patent Application Laid-open No. 2001-070858 is known. This is a die-coater type, in which a rotating rod bar is used, and coating material is discharged from a discharging slit to the rod bar to form a coating film on the rod bar. The formed coating film is brought into contact with an application medium and is transferred thereto as the rod bar rotates. When the coating film formed on the rod bar is not transferred or applied to an application medium, the coating material returns into the head as the rod bar rotates, and the material is collected via a collection slit. In other words, even when the application is not carried out, the rod bar keeps rotating, and the coating material remains forming a coating film on the rod bar. In this way, it is made possible to obtain a uniform coating film even when the application media are intermittently supplied, and the application is intermittently performed thereto.

Among inkjet recording apparatuses, one which utilizes a liquid application mechanism is known. According to the description in Japanese Patent Application Laid-open No. 2002-517341, a doctor blade abutting a roller is used, coating liquid is stored between the blade and the roller, and the coating liquid is applied to the roller as the roller rotates. As the roller rotates, the applied coating liquid is transferred or applied to a base material transferred between this roller and another roller. Also in Japanese Patent Application Laid-open No. 8-072227 (1996), shown is a mechanism which previously applies a treatment liquid insolubilizing dyes before recording, in an inkjet recording apparatus. The description of the first example in this document discloses that the treatment liquid in a replenishing tank adheres to a rotating roller and is thus pumped, and, at the same time, the pumped treatment liquid is applied to a recording paper.

However, with regard to the configurations described in the above documents, Japanese Patent Application Laid-open No. 2001-70858, Japanese Patent Application Laid-open No. 2002-517341 and Japanese Patent Application Laid-open No. 8-72227 (1996), the rod bar or the roller rotates, and the application liquid is applied or supplied to the surface of the bar or the roller, in which the area where the application or supply is performed, is opened to or communicates with the atmosphere. For this reason, there arises the problem of vaporization of the application liquid. In addition, there is a possibility that the problem can occur that, when the position of the apparatus changes, this results in the leakage of the application liquid.

Among others, with regard to the inkjet recording apparatuses, such as printers, with the leakage of the liquid due to the position change at the time of carrying taken into consideration, it is difficult to apply the application mechanism described in the above documents to downsized apparatuses.

Meanwhile, in Japanese Patent Application Laid-open No. 8-058069 (1996), disclosed is a gravure printing machine having a configuration in which the area is sealed off where ink as the application liquid is applied or supplied to a roller which has a print pattern formed on the surface thereof. With regard to this apparatus, an ink chamber having two doctor blades is brought into contact with the circumferential surface of the roller to form a liquid room (an ink reservoir) between the chamber and the roller.

In the apparatus described in Japanese Patent Application Laid-open No. 8-58069 (1996), a pump is provided between an ink tank to store ink and the liquid room. The ink in the ink tank is pumped into the liquid room by the pump, so that the ink is supplied from the ink tank to the liquid room. In addition, the ink in the liquid room is sent to a receiving tank which receives the ink discharged from the liquid room.

In that occasion, in a case where the apparatus has been stopped for a long time period, thickening or sticking of the application liquid due to vaporization and precipitation thereof sometimes occurs in the ink room and in a flow channel for sending ink to the ink room. However, with respect to this problem of thickening and sticking of the application liquid in the flow channel, there is no mention in Japanese Patent Application Laid-open No. H08-58069 A.

In a case where the application liquid has vaporized in the channel and thereby has thickened or stuck therein, circulation of the application liquid is sometimes hindered. As a result it is sometimes made difficult to perform favorable circulation to the extent that reliability of the application device can be maintained. For example, when the thickening has occurred in the ink room, viscosity of the liquid to be applied has become higher than usual. In a case where an adequate application has been hindered thereby, partial nonuniformity in the application is sometimes generated. There is concern that this nonuniformity adversely affects the image to be printed eventually such as mottling.

SUMMARY OF THE INVENTION

An object of the present invention is to provide a liquid application device and an inkjet recording apparatus, which are capable of reducing nonuniform application of liquid to a medium.

In first aspect of the present invention, a liquid application device comprises: liquid application means including an application member for applying liquid to a medium, and a retention member for retaining the liquid in a liquid retention space formed in contact with the application member, wherein the liquid application means applies the liquid retained in the liquid retention space to the medium via the application member by rotating the application member; storage unit for storing the liquid; passage which cause the storage means and the retention member to communicate with each other; circulating means for circulating the liquid in a channel including the storage unit, the passage, and the liquid retention space; obtaining means for obtaining information concerning lapse of time after the previous circulation operation by the circulating means; wherein, the circulating means controls a circulation operation according to the information obtained by the obtaining means.

In second aspect of the present invention, a liquid application device comprises: liquid application means including an application member for applying liquid to a medium, and a retention member for retaining the liquid in a liquid retention space formed in contact with the application member, wherein the liquid application means applies the liquid retained in the liquid retention space to the medium via the application member by rotating the application member; storage unit for storing the liquid; passage which cause the storage means and the retention member to communicate with each other; and circulating means for circulating the liquid in a channel including the storage unit, the passage, and the liquid retention space; wherein, the circulating means make a circulation speed of the current circulation operation faster, or a circulation period of the current circulation operation longer, as lapse of time after the previous circulation operation takes longer.

In third aspect of the present invention, a liquid application device comprises: liquid application means including an application member for applying the liquid to a medium, and a retention member for retaining the liquid in a liquid retention space formed in contact with the application member, wherein the liquid application means applies the liquid retained in the liquid retention space to the medium via the application member by rotating the application member; storage unit for storing the liquid; passage which cause the storage means and the retention member to communicate with each other; circulating means for circulating the liquid in a channel including the storage unit, the passage, and the liquid retention space; memory means for storing first information concerning a finish of a circulation operation by the circulating means; first obtaining means for, based on the first information stored in the memory means, obtaining second information concerning lapse of time after the previous circulation operation; and second obtaining means for, based on a data which associates the lapse of time with the circulation operation, obtaining third information concerning the circulation operation corresponding to the second information; wherein, the circulating means controls the current circulation operation according to the third information obtained by the second obtaining means.

In fourth aspect of the present invention, an inkjet recording apparatus comprises: the liquid application device according to the first aspect of the present invention; and recording means for recording an image on a medium by ejecting ink from a recording head to the medium to which the liquid has been applied by the liquid application device.

In fifth aspect of the present invention, a recording apparatus comprises: the liquid application device according to claim 1; and recording means for recording an image on a medium by applying a recording agent to the medium to which the liquid has been applied by the liquid application device.

In sixth aspect of the present invention, a method of controlling a liquid application device, comprises: a step of preparing the liquid application device including an application member for applying the liquid to the medium, and a retention member for retaining the liquid in a liquid retention space formed in contact with the application member, wherein liquid application device applies the liquid retained in the liquid retention space to the medium via the application member by rotating the application member; a first step of circulating the liquid in a channel including a storage means for storing the liquid, passage, and the liquid retention space, the passage causing the storage means, and the retention member to communicate with each other; a second step of obtaining information concerning a lapse of time after a finish of the first step; and a third step of circulating the liquid in the channel depending on the information obtained in the second step.

According to the present invention, a circulation operation is controlled on liquid in accordance with the lapse of time after the previous circulation operation. In so doing, the circulation operation is executable as being suitable for the degree of vaporization of the liquid, the degree varying depending upon the lapse of time. As a result, the thickening and/or the sticking of the liquid in the channel are reduced, and it becomes possible to reduce nonuniformity in the application derived from these thickening and/or sticking.

Further features of the present invention will become apparent from the following description of exemplary embodiments (with reference to the attached drawings).

BRIEF DESCRIPTION OF THE DRAWINGS

FIG. 15 is a diagram showing a table, by which a preliminary circulation sequence is determined, according to the embodiment of the present invention;

FIG. 16 is a diagram showing a table, by which contents of the preliminary circulation sequence are determined, according to the embodiment of the present invention;

FIG. 18 is a diagram showing tables, by which the preliminary circulation sequence is determined, according to the embodiment of the present invention;

DESCRIPTION OF THE EMBODIMENTS

Detailed description will be given below of a preferred embodiment of the present invention with reference to the accompanying drawings.

First Embodiment

Figure 1:
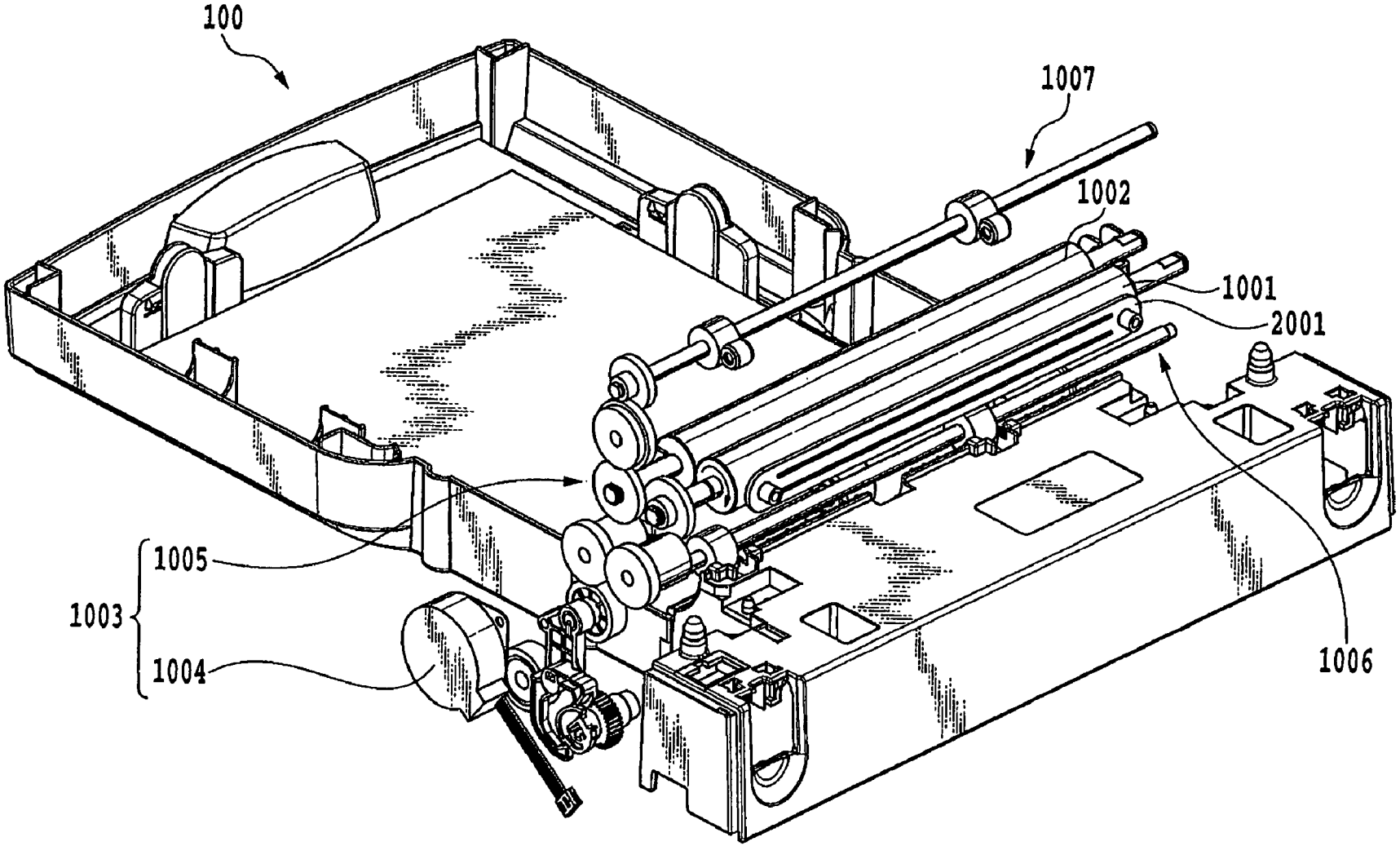
FIG. 1 is a perspective view showing an overall construction of an embodiment of a liquid application device of the present invention.

FIG. 1 is a perspective view showing an overall structure of the embodiment of a liquid application device 100 of the present invention. The liquid application device 100 shown here generally includes liquid application means for applying a predetermined application liquid to a medium (hereinafter also referred to as the application medium) which is an object to which the liquid is applied and liquid supply means for supplying the application liquid to the liquid application means.

The liquid application means includes a cylindrical application roller 1001, a cylindrical counter roller (a medium supporting member) 1002 placed so as to face the application roller 1001 and a roller drive mechanism 1003 driving the application roller 1001. The roller drive mechanism 1003 includes a roller drive motor 1004 and a power transmission mechanism 1005 including a gear train for transmitting the driving force of the roller drive motor 1004 to the application roller 1001.

The liquid supply means includes a liquid retention member 2001 retaining the application liquid between itself and a circumferential surface of the application roller 1001, and a liquid channel 3000 (not shown in FIG. 1), to be described later, supplying the liquid to the liquid retention member 2001. The application roller 1001 and the counter roller 1002 are freely rotatably supported individually by parallel shafts, each of which has both ends thereof freely rotatably fitted to a frame (not shown). The liquid retention member 2001 extends substantially over the entire length of the application roller 1001, and is movably mounted to the frame via a mechanism which enables the liquid retention member 2001 to come into contact with or to separate from the circumferential surface of the application roller 1001.

The liquid application device of this embodiment further includes an application medium feeding mechanism 1006 for transferring the application medium to a nip area between the application roller 1001 and the counter roller 1002, the application medium feeding mechanism 1006 being constituted of a pickup roller and other elements. In a transfer path of the application media, a sheet discharging mechanism 1007 transferring, to a sheet discharging unit (not shown), the application medium to which the application liquid has been applied is provided downstream of the application roller 1001 and the counter roller 1002, the sheet discharging mechanism 1007 having a sheet discharging roller and other elements. As in the case of the application roller and the like, these paper feeding mechanism and the sheet discharging mechanism are operated by the driving force of the drive motor 1004 transmitted via the power transmission mechanism 1005.

It should be noted that the application liquid used in this embodiment is a liquid used for the purpose of advancing the start of the coagulation of pigment when recording is carried out using an ink which contains pigment as a coloring material.

An example of components of the application liquid is described below.

| | |
|---|---|
| calcium nitrate tetrahydrate | 10% |
| glycerin | 42% |
| surface-active agent | 1% |
| water | the rest |

The viscosity of the application liquid is from 5 to 6 cP (centipoises) at 25° C.

Needless to say, in application of the present invention, the application liquid is not limited to the above liquid. As another application liquid, for example, a liquid which contains a component insolubilizing the dye or causing the coagulation of the dye, can be used. As yet another application liquid, a liquid which contains a component suppressing curling of the application media (the phenomenon that the media take a curved shape), can be used.

In a case where water is used in the applied liquid, the sliding property at the contact area of the liquid retention member with the application roller of the present invention will be improved by mixing a component reducing the surface tension with the liquid. In the above example of the components of the applied liquid, glycerin and the surface-active agent are the components reducing the surface tension of water.

More detailed description will now be given of construction of each portion.

Figure 2:
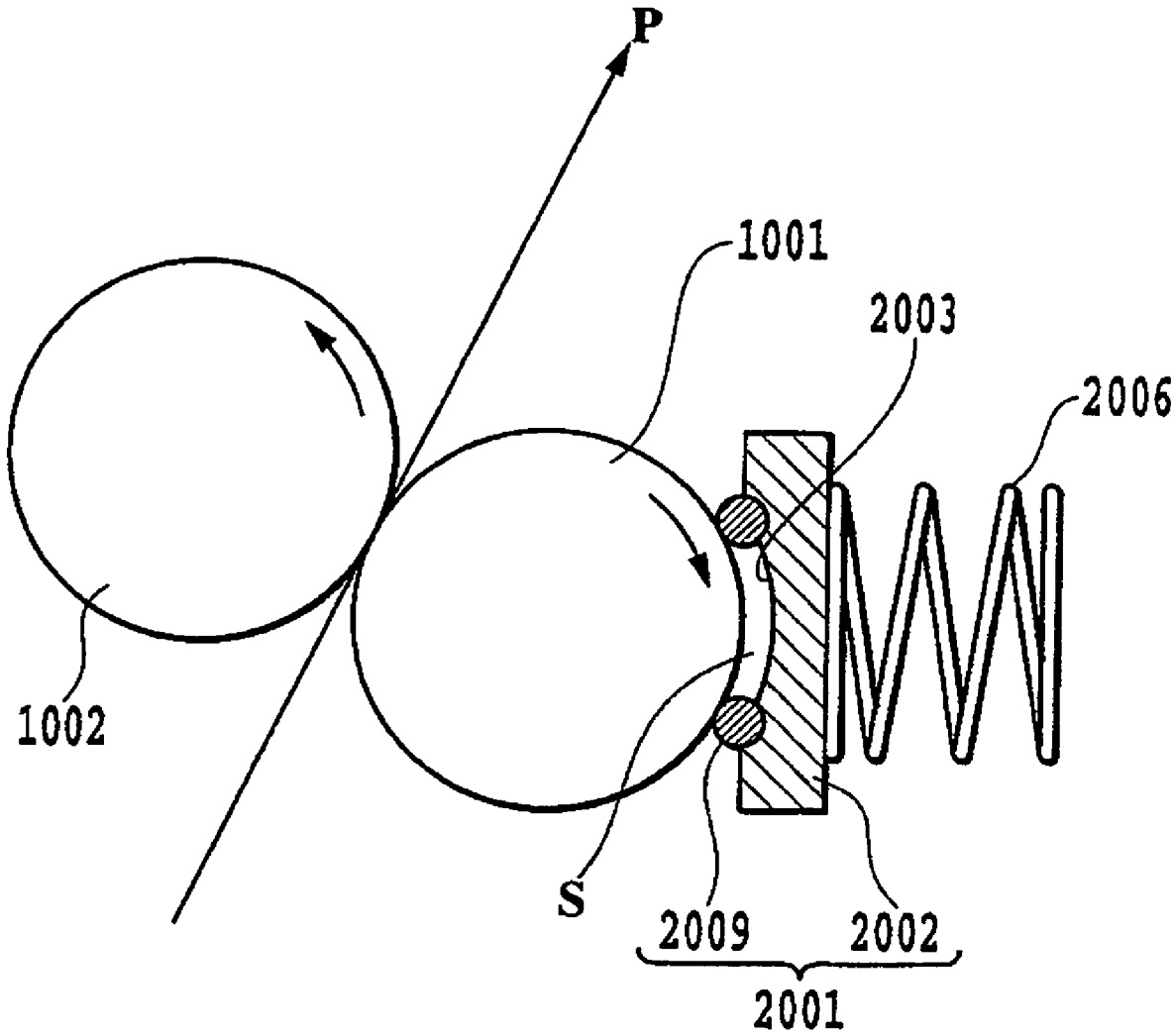
FIG. 2 is a longitudinal sectional side view showing an example of an arrangement of elements including an application roller, a counter roller and a liquid retention member.

FIG. 2 is an explanatory longitudinal sectional side view showing an example of an arrangement of elements including the application roller 1001, the counter roller 1002 and the liquid retention member 2001.

The counter roller 1002 is biased toward the circumferential surface of the application roller 1001 by bias means (not shown), and rotates the application roller 1001 clockwise in the figure. This rotation makes it possible to hold, between both rollers, the application medium P to which the application liquid is applied, and to transfer the application medium P in the direction indicated by the arrow in the figure.

The liquid retention member 2001 is designed to create an elongated liquid retention space S extending across a liquid application region of the application roller 1001 while the liquid retention member 2001 abuts on the circumferential surface of the application roller 1001, biased thereto by the bias force of a spring member (pressing means) 2006. The application liquid is supplied from the below-described liquid channel 3000 into the liquid retention space S through the liquid retention member 2001. In this case, since the liquid retention member 2001 is constructed as described below, it is possible to prevent the application liquid from accidentally leaking out of the liquid retention space S while the application roller 1001 is stopped.

A construction of the liquid retention member 2001 is shown in FIGS. 3 to 8.

Figure 3:
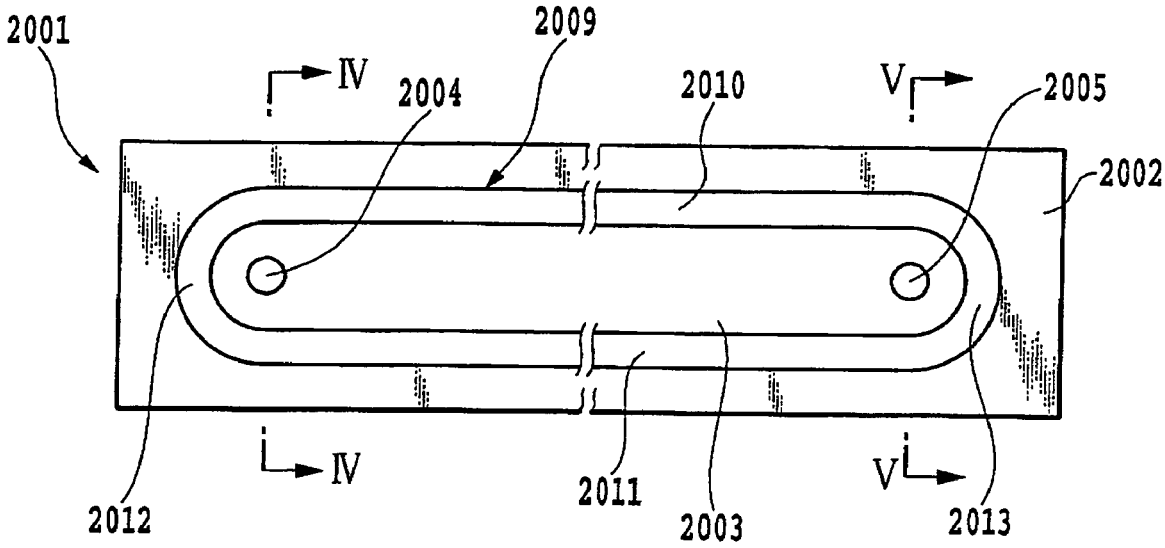
FIG. 3 is a front view of the liquid retention member shown in FIGS. 1 and 2.

As shown in FIG. 3, the liquid retention member 2001 includes a space creating base 2002 and an annular contact member 2009 provided on one surface of the space creating base 2002 in a protruding manner. In the space creating base 2002, a concave portion 2003, a bottom portion of which has a circular-arc cross section, is formed in the middle thereof along the longitudinal direction. Each straight portion of the contact member 2009 is fixedly attached to the space creating base 2002 along the edge portion of the concave portion 2003, and each circumferential portion thereof is fixedly attached to the space creating base 2002 so as to run from one edge portion to the other edge portion via the bottom portion. In this way, when abutting on the application roller 1001, the contact member 2009 of the liquid retention member 2001 can abut thereon in conformity with the shape of the circumferential surface of the application roller, which realizes the abutting with a uniform pressure.

As described above, with regard to the liquid retention member in this embodiment, the seamless contact member 2009 formed in one body is caused to abut on the outer circumferential surface of the application roller 1001 consecutively with no space therebetween by the bias force of the spring member 2006. As a result, the liquid retention space S becomes a substantially closed space defined by the contact member 2009, one surface of the space creating base and the outer circumferential surface of the application roller 1001, and the liquid is retained in this space. Thus, while the rotation of the application roller 1001 is stopped, the contact member 2009 and the outer circumferential surface of the application roller 1001 can keep a fluid-tight state, and can surely prevent the liquid from leaking out. On the other hand, when the application roller 1001 rotates, as described later, the application liquid goes past the contact member 2009 in such a manner as to pass through the interface between the outer circumferential surface of the application roller 1001 and the contact member 2009 and adheres to the outer circumferential surface of the application roller like layer. "While the application roller 1001 is stopped, the outer circumferential surface thereof and the contact member 2009 are in a fluid-tight state" means that, as described above, the liquid is not allowed to pass through the boundary between the inside and the outside of the space. In this case, the abutting condition of the contact member 2009 includes a condition where the contact member 2009 abuts on the outer circumferential surface of the application roller 1001 with a film of the liquid, which is formed by the capillary action, interposed therebetween, as well as a condition where the contact member 2009 directly abuts on the outer circumferential surface of the application roller 1001.

Figure 4:
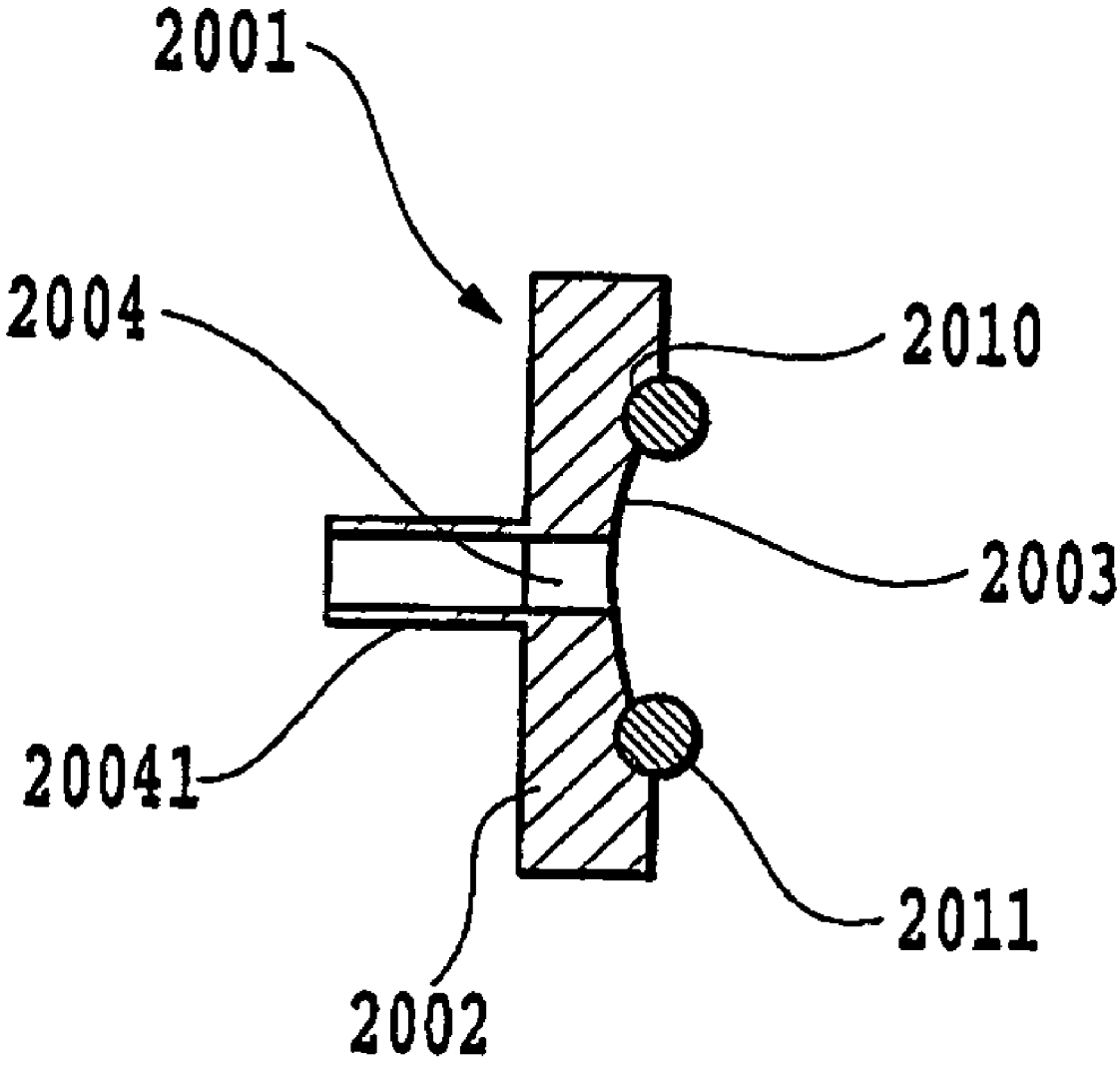
FIG. 4 is an end view showing an end obtained by cutting the liquid retention member shown in FIG. 3 along the line IV-IV.
Figure 5:
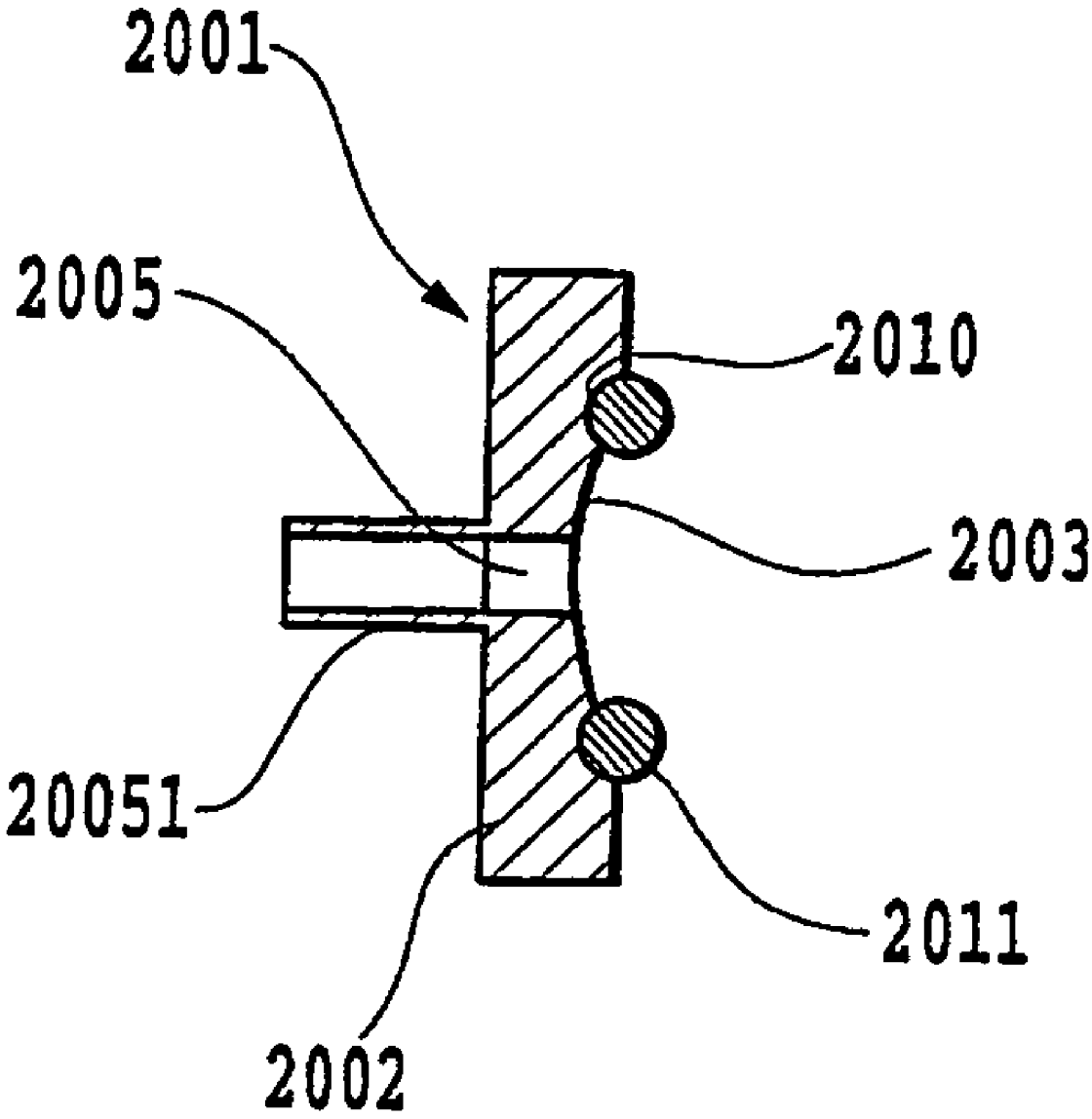
FIG. 5 is an end view showing an end obtained by cutting the liquid retention member shown in FIG. 3 along the line V-V.
Figure 6:
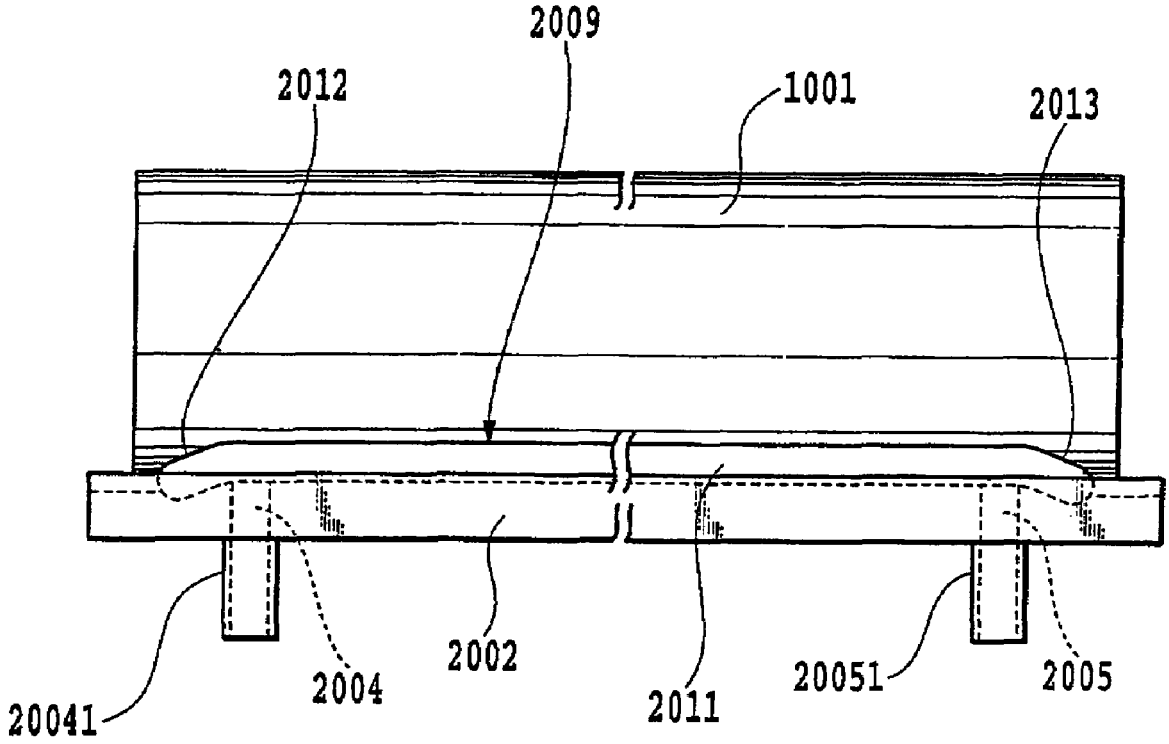
FIG. 6 is a plan view of the liquid retention member shown in FIG. 3.
Figure 7:
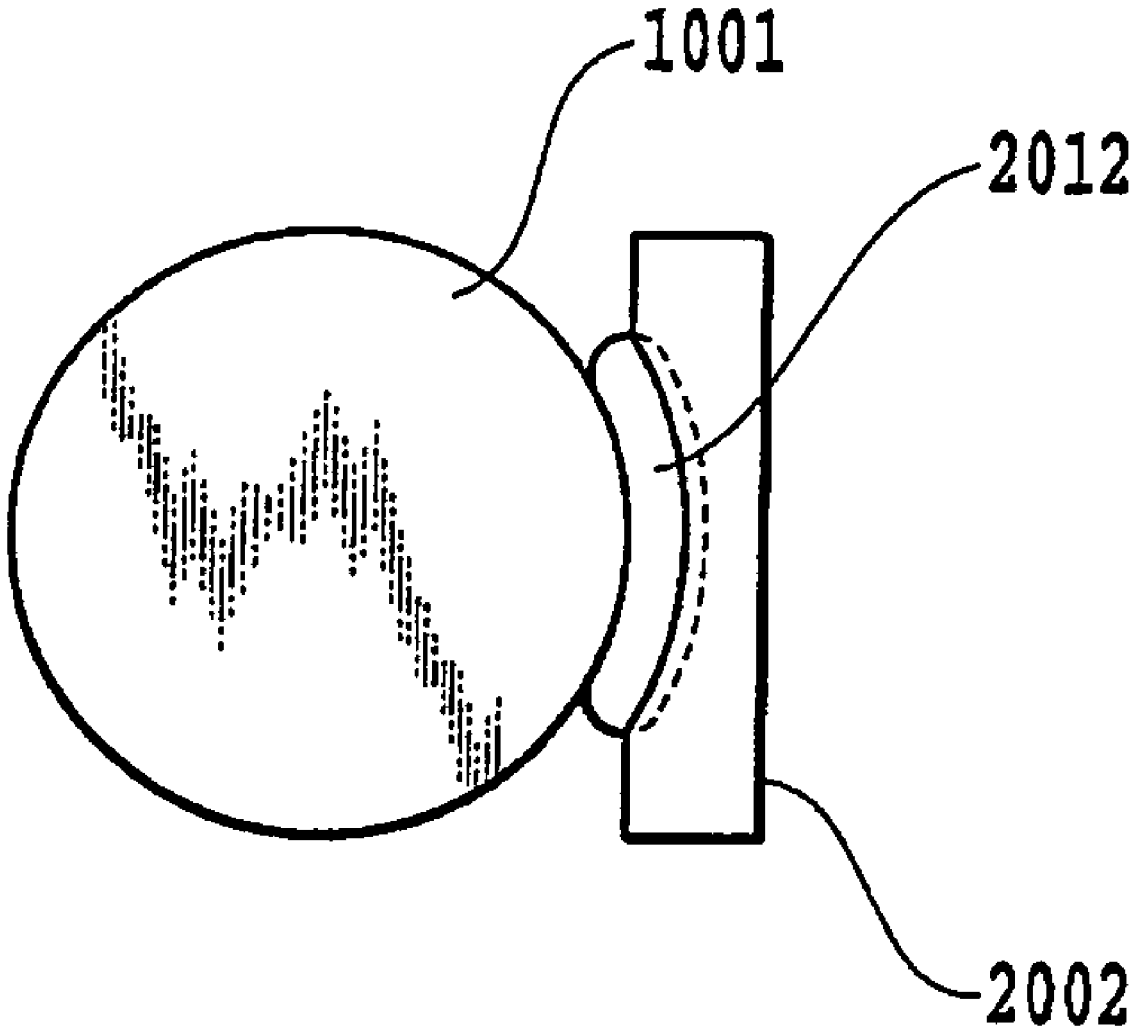
FIG. 7 is a left side view showing a state where a contact portion of the liquid retention member shown in FIG. 3 is allowed to abut on the liquid application roller.
Figure 8:
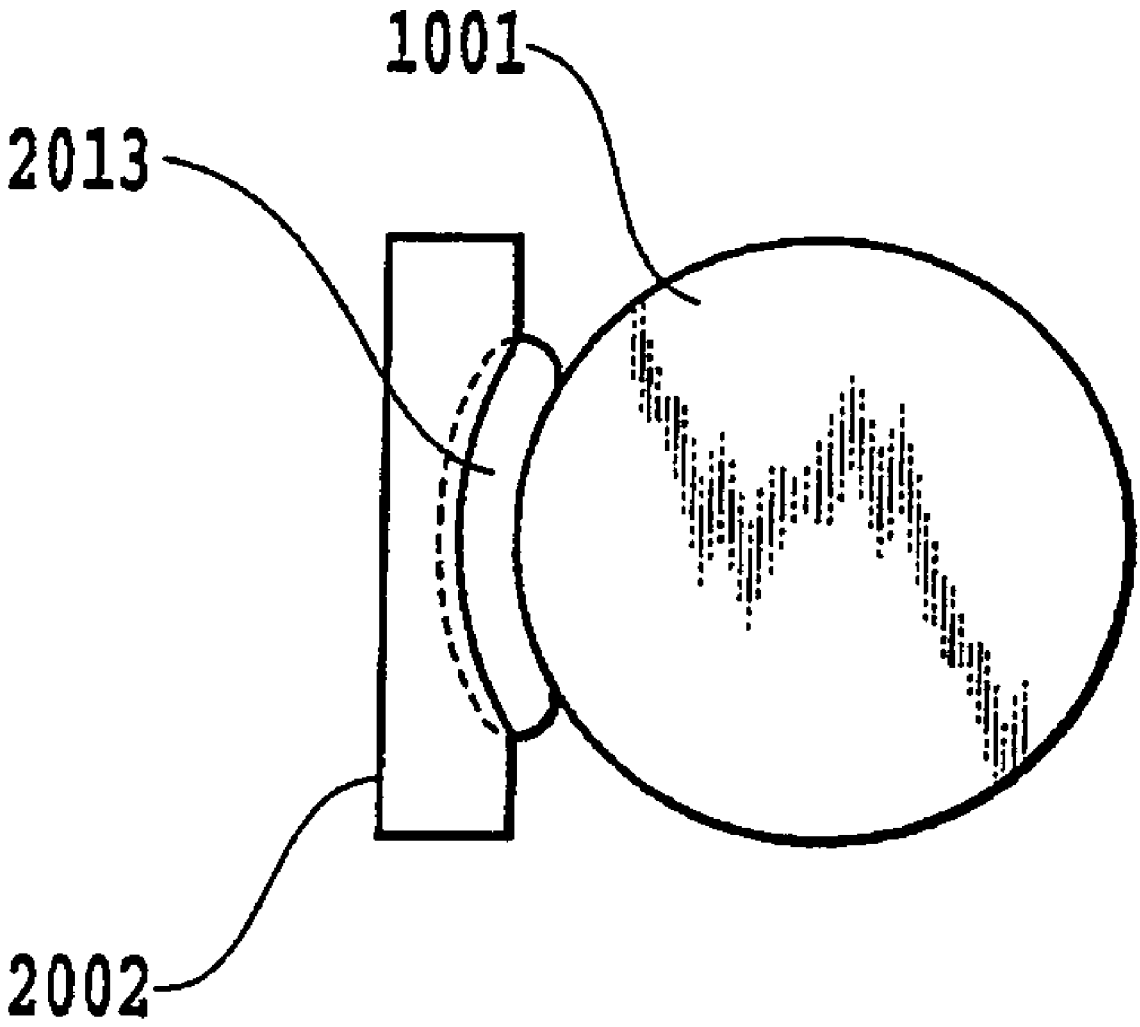
FIG. 8 is a right side view showing a state where the contact portion of the liquid retention member shown in FIG. 3 is allowed to abut on the liquid application roller.

The left and right end portions of the contact member 2009 in the longitudinal direction have a gently curved shape when viewed from any one of the front thereof (FIG. 3), the top thereof (FIG. 6), and a side thereof (FIGS. 7 and 8), as shown in FIGS. 3 to 8. As a result, even when the contact member 2009 is allowed to abut on the application roller 1001 with a relatively high pressure, the whole contact member 2009 is elastically deformed substantially uniformly, and local large deformation does not occur. Thus, the contact member 2009 abuts on the outer circumferential surface of the application roller 1001 consecutively with no space therebetween, and can create the substantially closed space, as shown in FIGS. 6 to 8.

On the other hand, as shown in FIGS. 3 to 5, the space creating base 2002 is provided with a liquid supply port 2004 and a liquid collection port 2005 in the region surrounded by the contact member 2009, each port being formed by making a hole penetrating the space creating base 2002. These ports communicate with cylindrical joint portions 20041 and 20051, respectively, which are provided on a back side of the space creating base in a protruding manner. The joint portions 20041 and 20051 are in turn connected to the below-described liquid channel 3000. In this embodiment, the liquid supply port 2004 is formed near one end portion (the left end portion in FIG. 3) of the region surrounded by the contact member 2009, and the liquid collection port 2005 is provided near the other end portion (the right end portion in FIG. 3) of the same region. The liquid supply port and the liquid collection port are not limited by the above configuration, and may be formed at any location in the space creating base. In addition, the number of the liquid supply ports and the number of the liquid collection ports may be arbitrary. The liquid supply port 2004 is used to supply, to the above-described liquid retention space S, the application liquid supplied from the liquid channel 3000. The liquid collection port 2005 is used to allow the liquid in the liquid retention space S to flow out to the liquid channel 3000. By supplying the liquid and allowing the liquid to flow out, the application liquid is caused to flow from the left end portion to the right end portion in the liquid retention space S.

(Application Liquid Channel)

Figure 11:
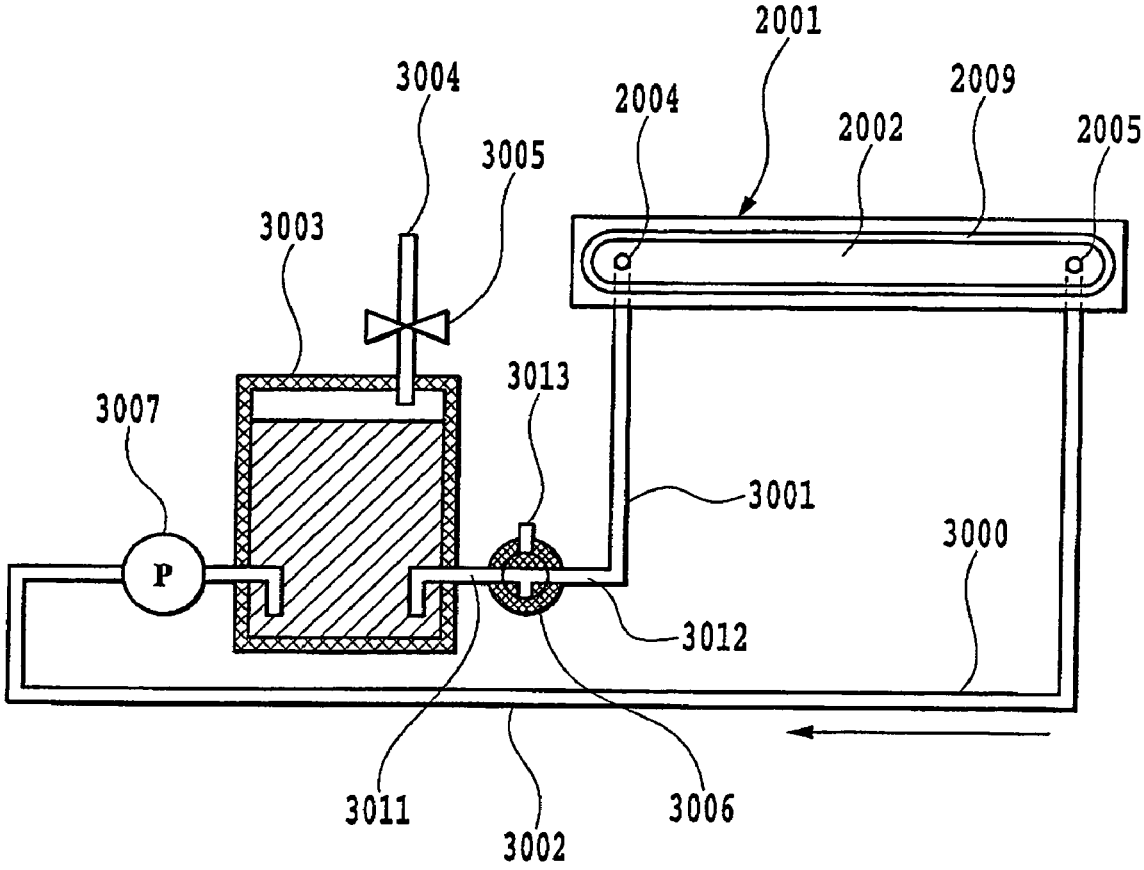
FIG. 11 is a diagram showing a schematic configuration of a liquid channel of the liquid application device in the embodiment of the present invention.

FIG. 11 is an explanatory diagram showing a schematic configuration of the liquid channel 3000 connected to the liquid retention member 2001 of the application liquid supply means.

The liquid channel 3000 has a first channel 3001 which connects the liquid supply port 2004 of the space creating base 2002 being an element of the liquid retention member 2001, and a storage tank 3003 storing the application liquid. In addition, the liquid channel 3000 has a second channel 3002 which connects the liquid collection port 2005 of the space creating base 2002 and the storage tank 3003. This storage tank 3003 is provided with an atmosphere communication port 3004, and the atmosphere communication port is provided with an atmosphere communication valve 3005 switching between an atmosphere communicating state and an atmosphere isolation state. The atmosphere communication port 3004 preferably has a labyrinth structure in order to suppress vaporization. In addition, a switching valve 3006 is provided in the first channel 3001, making it possible to switch between the state where the first channel 3001 and the atmosphere communicate with each other and the state where these are isolated from each other. In the second channel 3002, a pump 3007 is connected, which is used to force the application liquid and air to flow in a desired direction in the liquid channel 3000.

In this embodiment, the first and second channels 3001 and 3002 are formed of circular tubes. Openings formed at respective ends of the tubes are located at or near the bottom of the storage tank 3003, so that the application liquid in the storage tank 3003 can be completely consumed.

Figure 19:
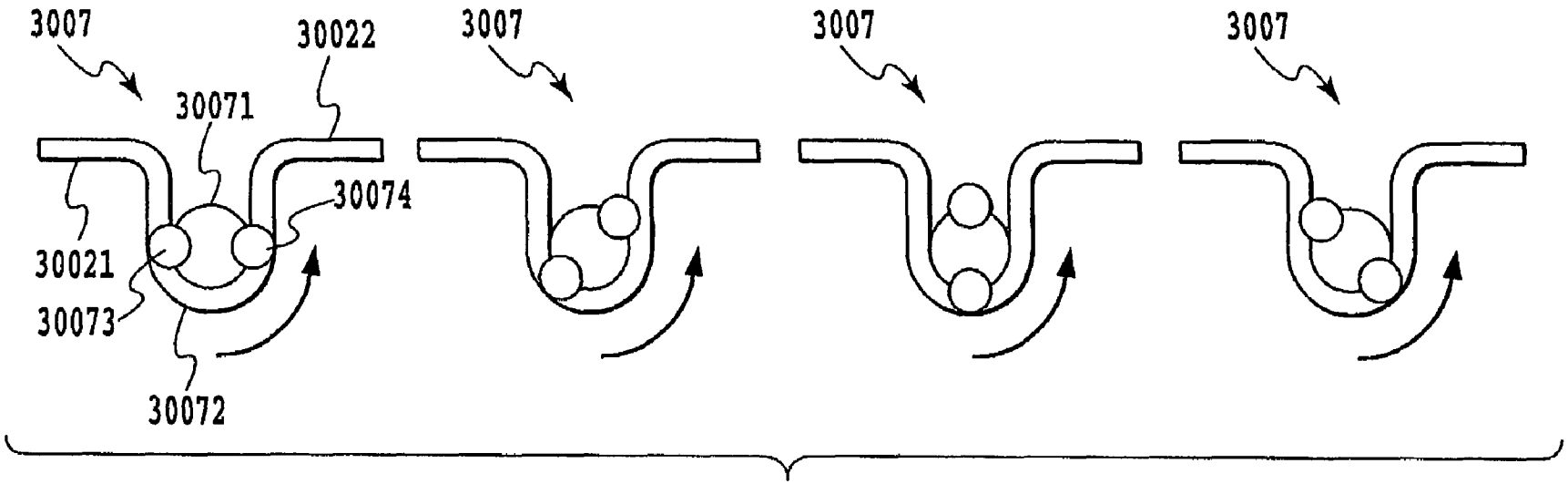
FIG. 19 is a diagram for explaining an operation of a pump in the embodiment of the present invention.

The pump 3007 in this embodiment is constituted of a tube pump as shown in FIG. 19. The tube pump 3007 includes a rotor 30071 rotated by a pump drive motor (not shown) and a pump forming tube 30072 having flexibility, which is disposed in an arc shape along the periphery of the rotor 30071. In addition, the tube pump 3007 has two rollers 30073 and 30074 freely rotatably supported by the rotor 30071. In this tube pump, when the rotor 30071 rotates, at least one of the rollers 30073 and 30074 rolls while squeezing the pump forming tube 30072. This rolling movement causes the application liquid or air in the pump forming tube 30072 to be fed to the downstream side (to the storage-tank side tube 30022 in FIG. 12), and, at the same time, causes the application liquid or air to be sucked from the liquid-retention-member side tube 30021. While the tube pump 3007 is stopped, the pump forming tube is always in a squeezed state, and the communication between the tubes 30021 and 30022 is blocked.

Figure 13:
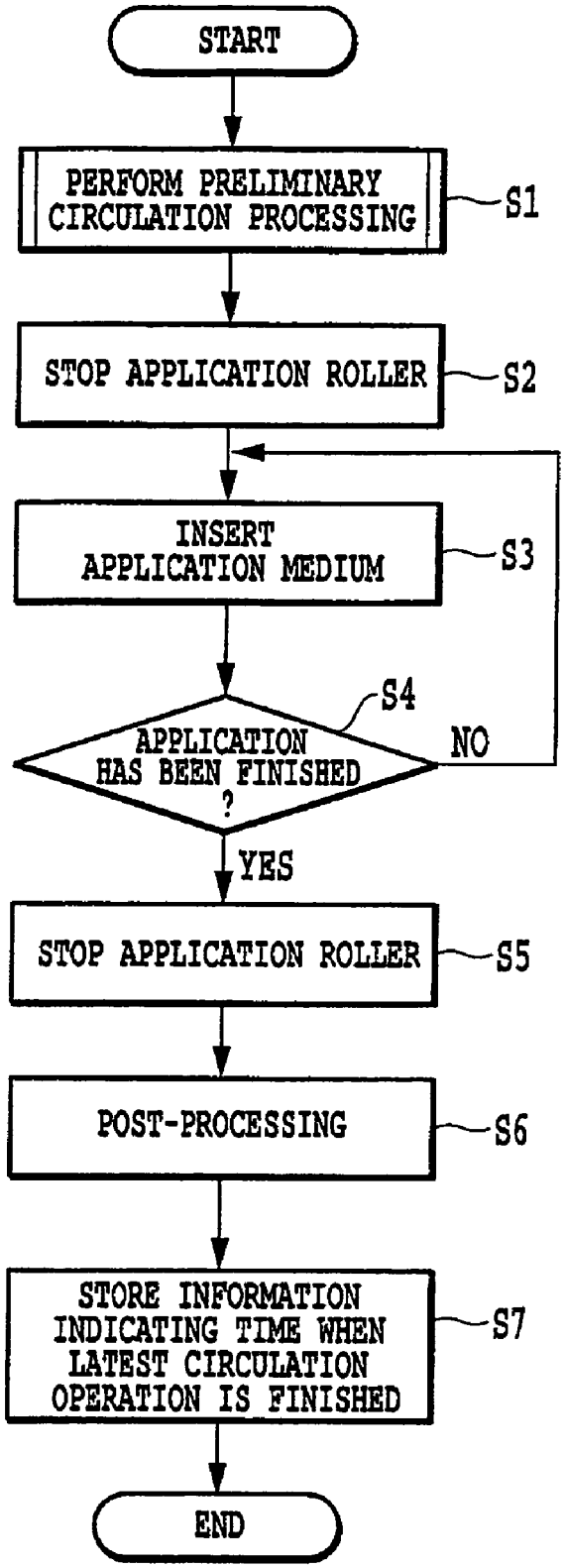
FIG. 13 is a flow chart showing a liquid-application operation sequence in the embodiment of the present invention.
Figure 14:
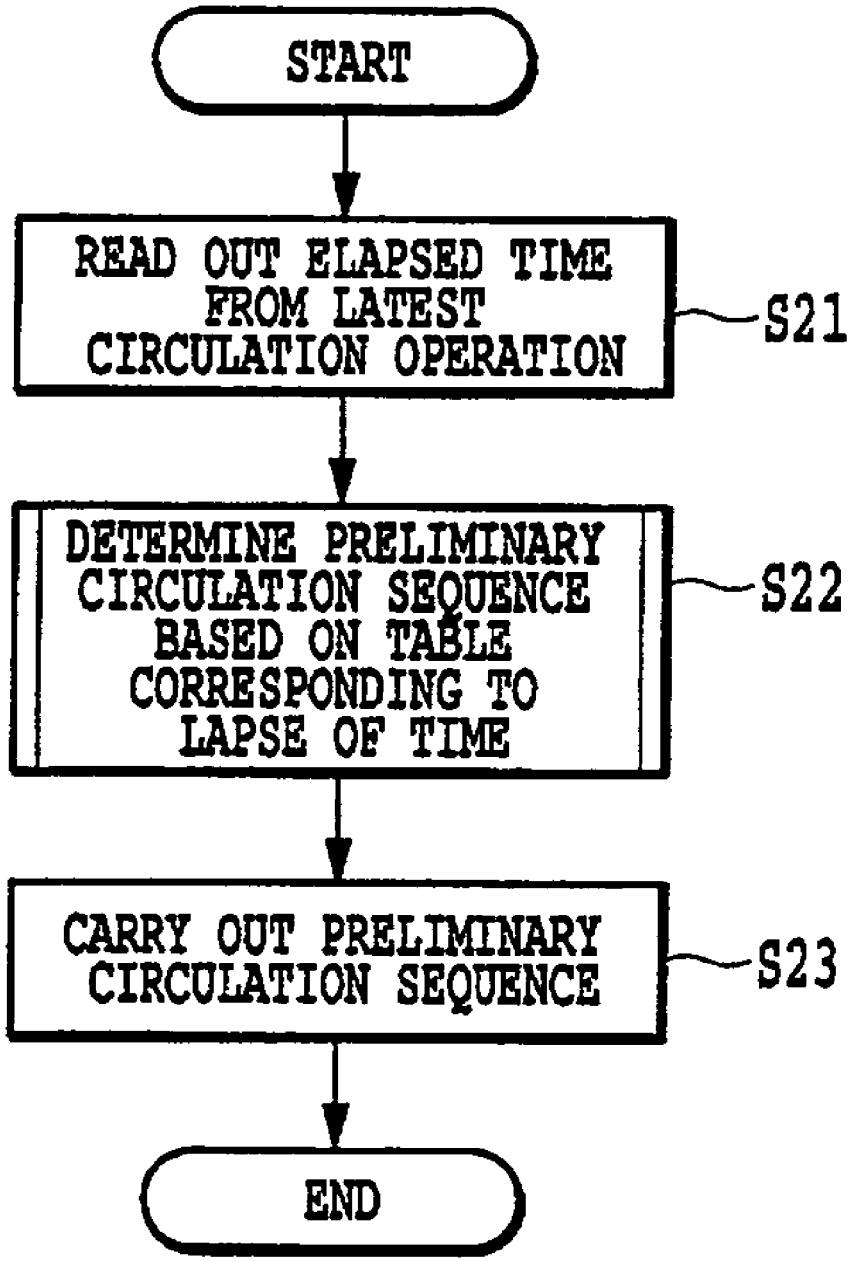
FIG. 14 is a flow chart showing the processing of a preliminary circulation operation according to the embodiment of the present invention.

For the switching valve 3006 in this embodiment, various kinds of valves can be used as long as the valve can switch between the state where the first channel 3001 and the atmosphere communicate with each other and the state where these are isolated from each other. In this embodiment, however, a three-way valve as shown in FIG. 11 is used. The three-way valve 3006 has three ports communicating with each other. The three-way valve 3006 is made capable of selectively causing two of these ports to communicate respectively with two of a storage-tank side tube 3011, a liquid-retention-member side tube 3012 and an atmosphere communication port 3013 in the first channel 3001. The switching of this three-way valve 3006 allows for the selective switching between a connection state where the tubes 3011 and 3012 are allowed to communicate with each other and a connection state where the tube 3012 and the atmosphere communication port 3013 are allowed to communicate with each other. In this way, it is made possible to selectively supply, to the liquid retention space S created by the liquid retention member 2001 and the application roller 1001, the application liquid in the storage tank 3003 or the air taken in from the atmosphere communication port 3013. Specifically, when the tubes 3011 and 3012 communicate with each other as shown in FIG. 13, the application liquid in the storage tank 3003 will be supplied to the liquid retention space S. On the other hand, when the tube 3012 and the atmosphere communication port 3013 communicate with each other as shown in FIG. 14, the air taken in from the atmosphere communication port 3013 is supplied to the liquid retention space S. The switching of the three-way valve 3006 is performed in accordance with a control signal from a below-described control unit 4000, so that the filling or the supply of the application liquid is performed.

(Control System)

Figure 12:
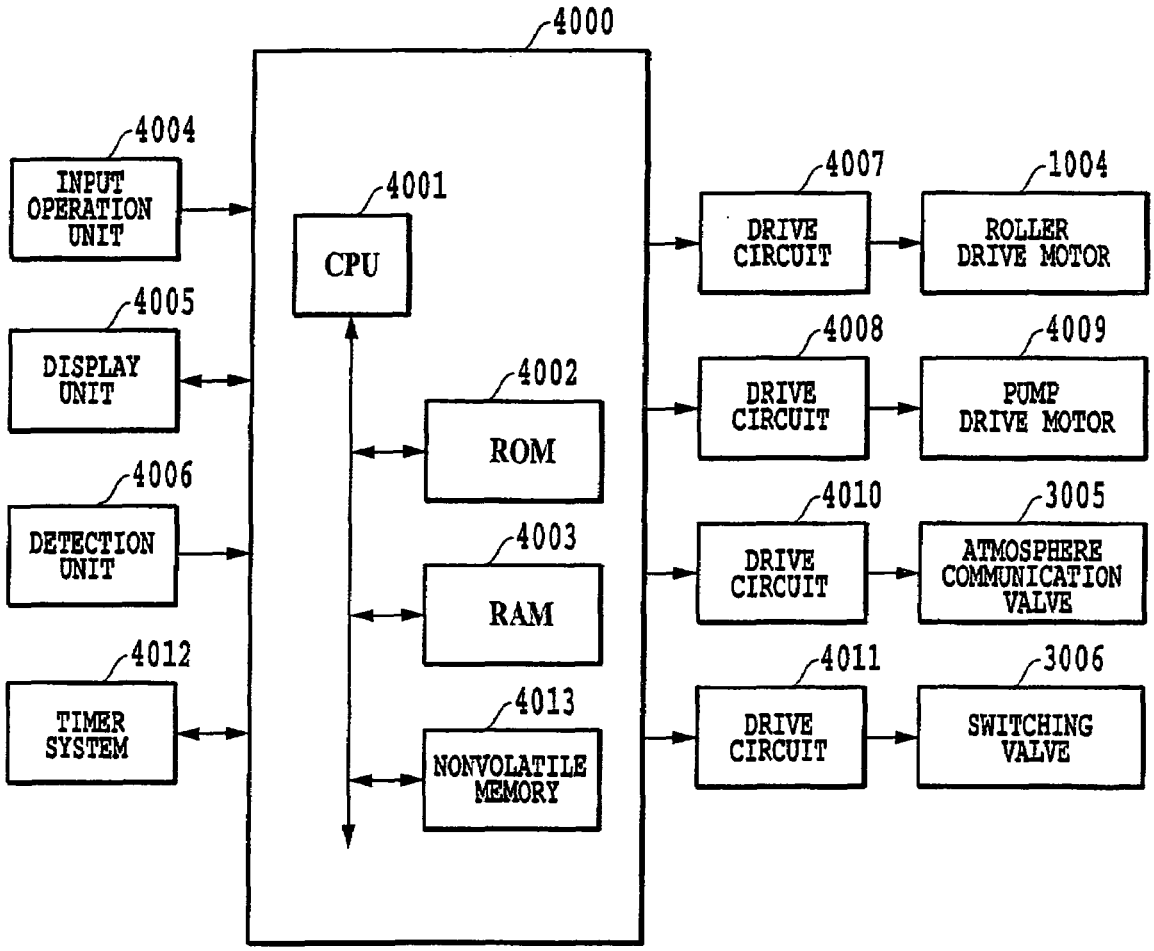
FIG. 12 is a block diagram showing a schematic configuration of a control system in the embodiment of the present invention.

FIG. 12 is a block diagram showing a schematic configuration of a control system in the liquid application device of this embodiment.

In FIG. 12, reference numeral 4000 denotes a control unit as control means for controlling the whole liquid application device. This control unit 4000 includes: a CPU 4001 which performs various processing, such as computation, control, and discrimination; and a ROM 4002 which stores a control program and the like, which are executed by this CPU 4001, for processes and the like described later in connection with FIG. 13. Additionally, the control unit 4000 further includes: a RAM 4003 which temporarily stores input data and data on which the CPU 4001 is performing processing; and a non-volatile memory 4013 such as a flash memory or an SRAM.

The control unit 4000 has the functions of: obtaining information indicating lapse of time after the previous liquid flowing operation (the previous circulating operation) which will be described later; and, based on this information indicating the lapse of time after the previous liquid flowing operation, controlling a preliminary circulation performed by liquid moving means (a pump).

Additionally, an input operation unit 4004 and a display unit 4005 are connected to the control unit 4000. The input operation unit 4004 includes a keyboard with which predetermined commands, data and the like are inputted, or various switches. The display unit 4005 displays various pieces of information such as input and setting of the liquid application device. In addition, a detection unit 4006 including a sensor for detecting the position of an application medium, the operation condition of each portion, or the like, and a timer system 4012 having a built-in battery are connected to the control unit 4000. Moreover, the roller drive motor 1004, a pump drive motor 4009, the atmosphere communication valve 3005 and the switching valve 3006 are connected to the control unit 4000 via drive circuits 4007, 4008, 4010 and 4011, respectively. It should be noted that the sensors constituting the detection unit 4006 include a liquid detecting sensor, and a temperature detecting sensor in the second embodiment.

In this embodiment, with the use of the above configuration, during an application operation (a liquid application operation) in which the application liquid is applied to application media, the stop and the activation (driving) of the pump 3007 are controlled in accordance with predetermined timing.

(Liquid Application Operation Sequence)

FIG. 13 is a flow chart showing a procedure relating to the liquid application by the liquid application device of this embodiment. Description will be given below of each step relating to the liquid application with reference to this flow chart. Once the liquid application device is turned on, the control unit 4000 carries out the following application operation sequence in accordance with the flow chart shown in FIG. 13.

Preliminary Circulation Step

In step S1, a later described preliminary circulation step is performed on each one of the following portions (hereinafter, referred to only as "the portions"): the liquid retention space S, the respective channels 3001 and 3002, the three-way valve 3006, and the pump 3007. The preliminary circulation step is performed regardless of whether or not the application liquid has been filled in the portions. A preliminary circulation sequence of this preliminary circulation step is performed by driving the pump 3007 for a certain period of time while opening the atmosphere communication valve 3005 of the storage tank 3003 to the atmosphere.

Note that, in a case where the application liquid has already been filled in the portions, it is only necessary to circulate the liquid in a flow channel including a route from the channel 3001 to the liquid retention space S, then to the channel 3002, and then to the storage tank 3003. On the other hand, in a case where the application liquid has not been filled in the portions, the liquid is filled in the portions while the liquid is circulated in the flow channel including the route from the channel 3001 to the liquid retention space S, then to the channel 3002, and then to the storage tank 3003.

This preliminary circulation may be performed while rotating the application roller, or performed with the application roller stopped. It might be preferable to rotate the application roller, in order to remove matter increased in the viscosity fixedly attached at the contact area of the liquid retention member with the application roller.

Note that "application liquid relating to the preliminary circulation" refers to application liquid actually circulated in the portions during the preliminary circulation step. Additionally, in a case where the thickened matter and/or stuck matter are miscible with the application liquid used in the preliminary circulation, the application liquid relating to the preliminary circulation includes the miscible matter mixed with the liquid.

Application Steps

After the preliminary circulation has been finished in step S1, the application roller 1001 starts to rotate clockwise as shown by the arrow in FIG. 1 (step S2). With this rotation of the application roller 1001, the application liquid L filled into the liquid retention space S overcomes the pressing force of the contact member 2009 of the liquid retention member 2001 against the application roller 1001, and passes through the interface between the application roller 1001 and a lower edge portion 2011 of the contact member 2009. This application liquid L having passed through the interface adheres to the outer circumferential surface of the application roller 1001 forming a layer. The application liquid L adhering to the application roller 1001 is sent to a contact portion between the application roller 1001 and the counter roller 1002.

Figure 9:
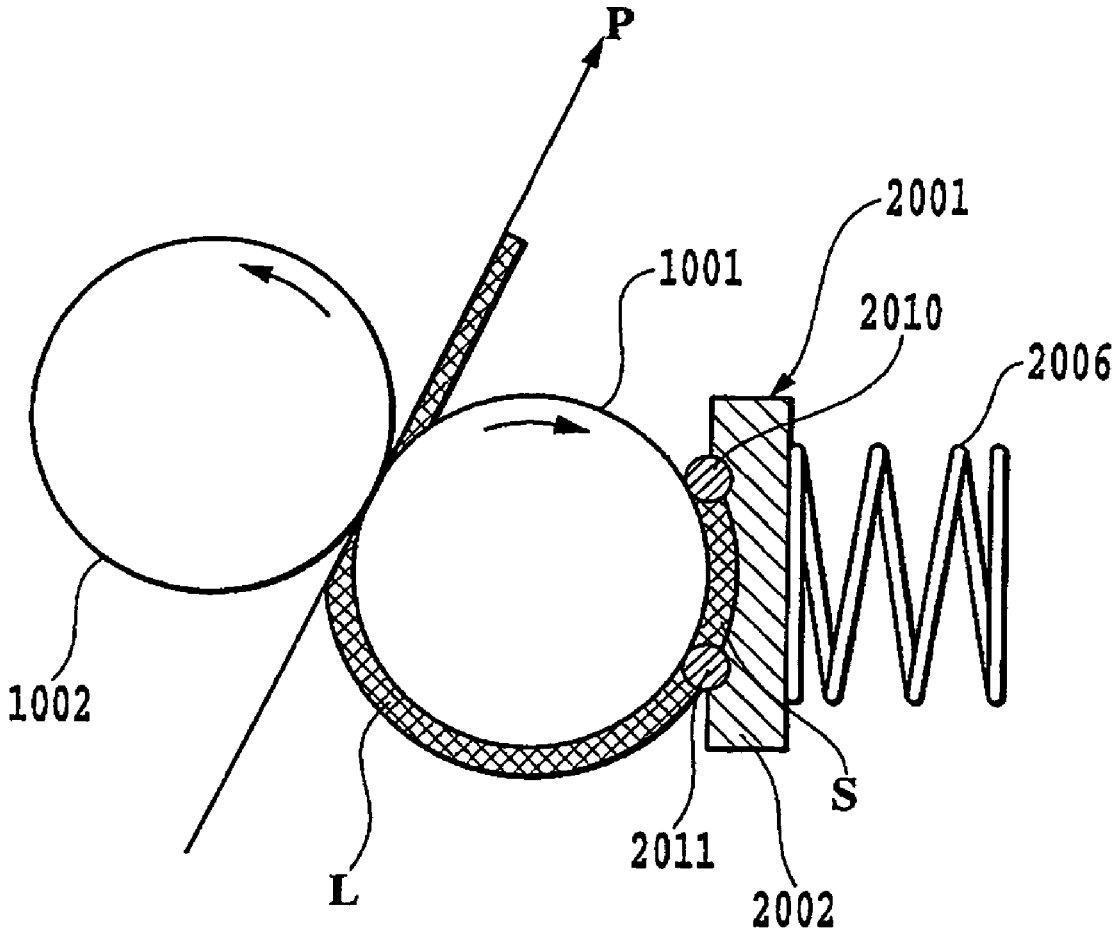
FIG. 9 is a longitudinal sectional view showing a state where a liquid retention space created by the liquid retention member and the application roller is filled with an application liquid, and the liquid is applied to an application medium as the application roller rotates in the embodiment of the present invention.

Subsequently, the application medium feeding mechanism 1006 transfers an application medium to the nip area between the application roller 1001 and the counter roller 1002, allowing the application medium to be inserted between these rollers. This inserted application medium is then transferred toward the delivery unit as the application roller 1001 and the counter roller 1002 rotate (step S3). During this transfer, the application liquid applied to the outer circumferential surface of the application roller 1001 is transferred from the application roller 1001 to the application medium P as shown in FIG. 9. Note that, needless to say, the means for feeding the application medium to the interface between the application roller 1001 and the counter roller 1002 is not limited to the above feeding mechanism. Any means can be used. For example, manual feeding means accessorily utilizing a predetermined guide member may be additionally used, or the manual feeding means may be used singly.

In FIG. 9, the cross hatched part indicates the application liquid L. It should be note that, in this figure, the thicknesses of the layers of the application liquid on the application roller 1001 and the application medium P is depicted relatively larger than the actual thickness, for the purpose of the clear illustration of the state of the application liquid L shown at the time of the application.

In this way, the part of an application medium P to which the liquid has been applied is transferred in the direction indicated by the arrow by the transferring force of the application roller 1001, and, at the same time, the part of the application medium P to which the liquid is not applied is transferred to the contact area between the application medium P and the application roller 1001. By performing this operation continuously or intermittently, the application liquid is applied to the entire surface of the application medium.

Incidentally, FIG. 9 shows an ideal state of application where all the application liquid L, which has passed the contact member 2009 and has stuck to the application roller 1001, has been transferred to the application medium P. In fact, however, all the application liquid L having stuck to the application roller 1001 is not always transferred to the application medium P. Specifically, in many cases, when the transferred application medium P moves away from the application roller 1001, the application liquid L also sticks to the application roller 1001, and thus remains on the application roller 1001. The remaining amount of the application liquid L on the application roller 1001 varies depending on the material of the application medium P and the microscopic irregularities of the surface. In a case where the application medium is a plain paper, the application liquid L remains on the circumferential surface of the application roller 1001 after the application operation.

Figure 24:
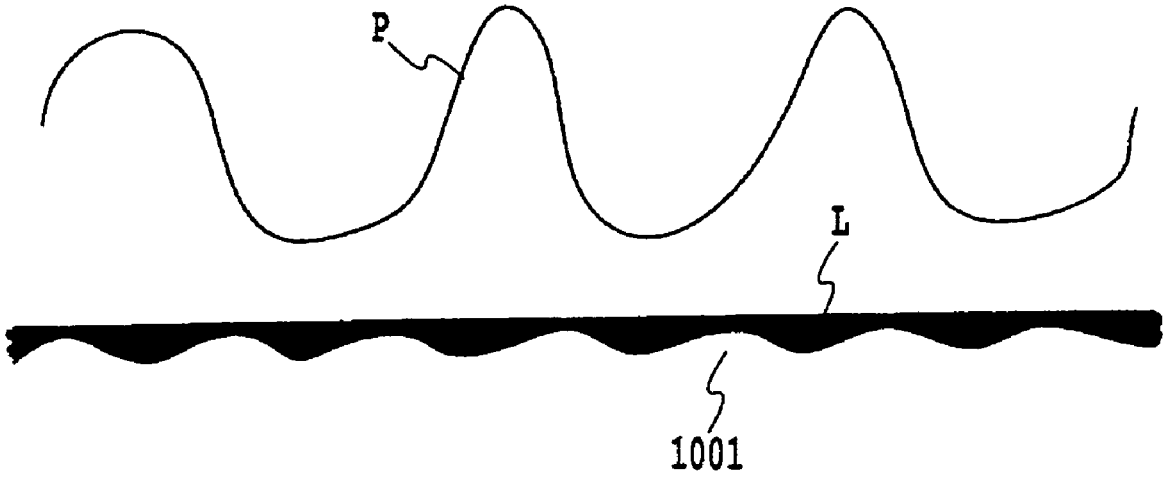
FIGS. 24 to 26 are explanatory diagrams for explaining an application process proceeding between an application surface and a surface of a medium, in a case where the medium P is a plain paper.
Figure 25:
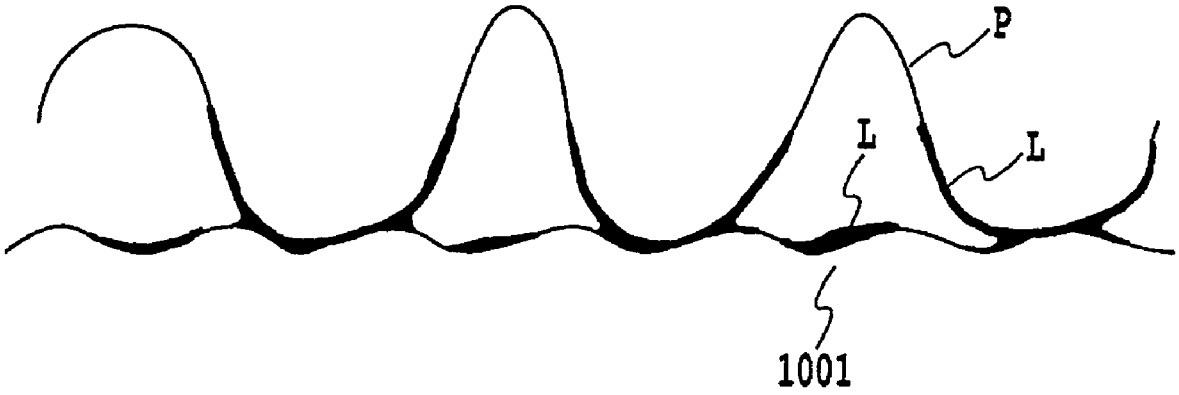
Figure 26:
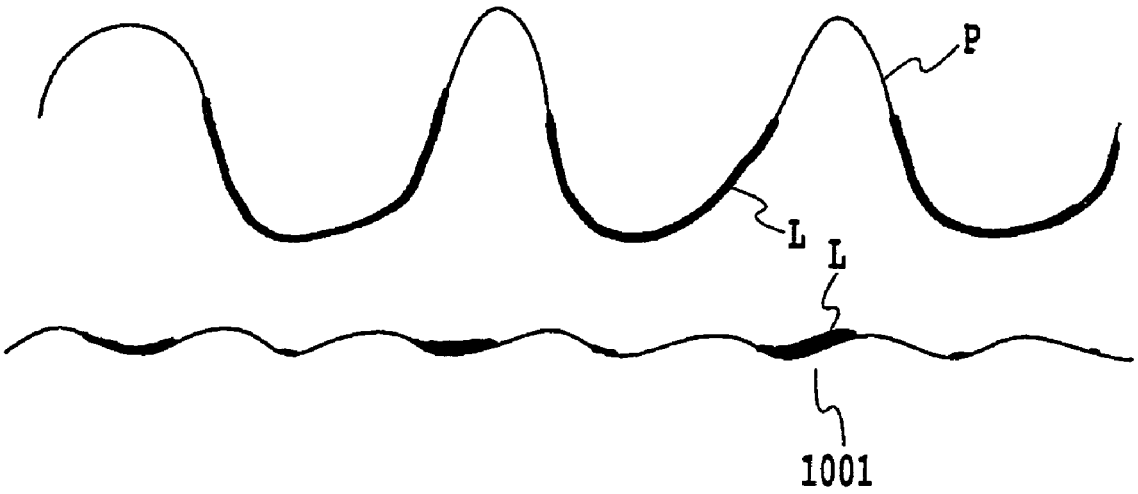

FIGS. 24 to 26 are explanatory diagrams for explaining an application process proceeding between the application surface and the surface of the medium in a case where the medium P is a plain paper. In these figures, the liquid is expressed by the regions filled in with black.

FIG. 24 shows a state of the application roller 1001 and the counter roller 1002 in an area upstream of the nip area thereof. In this figure, the liquid has stuck to the application surface of the application roller 1001 in such a manner that the liquid thinly covers the microscopic irregularities of the application surface.

FIG. 25 shows a state of both of the surface of the plain paper, which is the medium P, and the application surface of the application roller 1001 in the nip area of the application roller 1001 and the counter roller 1002. In this figure, the convex portions of the surface of the plain paper, which is the medium P, abuts on the application surface of the application roller 1001, and, from the abutting portions, the liquid instantly permeates into or sticks on the surface fibers of the plain paper, which is the medium P. The liquid which has stuck to the part of the application surface of the application roller 1001, which part does not abut on the convex portions of the surface of the plain paper, remains on the application surface of the application roller 1001.

FIG. 26 shows a state of the application roller 1001 and the counter roller 1002 in an area downstream of the nip area thereof. This figure shows a state where the medium and the application surface of the application roller 1001 have been completely separated from each other. The liquid sticking to those parts of the applying surface of the application roller 1001 which do not contact with the convex portions on the surface of the plain paper remains on the applying surface. The liquid on the contacting parts also remains with very small amount on the application surface.

The application liquid remaining on the application roller 1001 overcomes the pressing force of the contact member 2009 of the liquid retention member 2001 against the application roller 1001, passes through the interface between the application roller 1001 and an upper edge portion 2010 of the contact member 2009, and is brought back into the liquid retention space S. The returned application liquid is mixed with the application liquid filled in the liquid retention space S.

Figure 10:
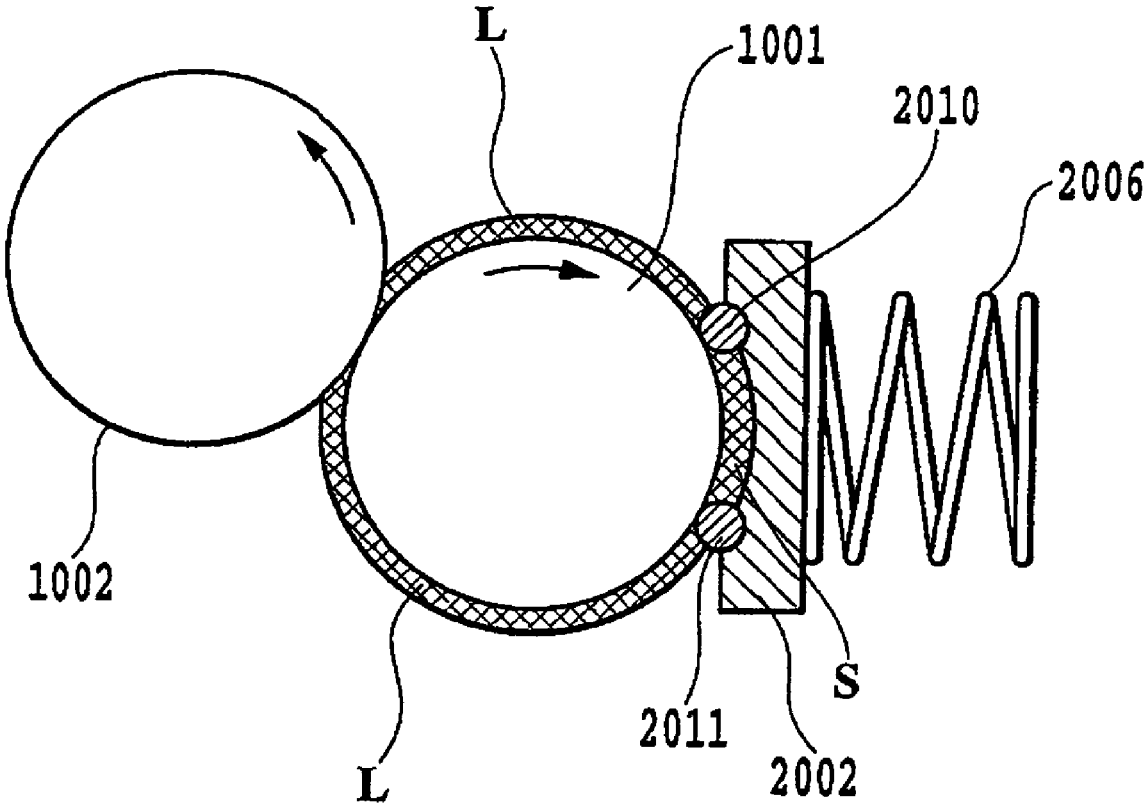
FIG. 10 is a longitudinal sectional view showing a state where the liquid retention space created by the liquid retention member and the application roller is filled with the application liquid, and the application roller is rotated with no application medium present in the embodiment of the present invention.

As shown in FIG. 10, also in a case where the application roller 1001 is rotated when there is no application medium, the returning operation of the application liquid is similarly performed. Specifically, the application liquid stuck to the circumferential surface of the application roller 1001 by rotating the application roller 1001 passes through the interface of the contact area between the application roller 1001 and the counter roller 1002. After this, the application liquid is distributed between the application roller 1001 and the counter roller 1002, and remains on the application roller 1001. The application liquid L sticking to the application roller 1001 passes through the interface between the upper edge portion 2010 of the contact member 2009 and the application roller 1001, enters the liquid retention space S, and is mixed with the application liquid filled in the liquid retention space S.

Finishing Steps

Once the application operation to the application medium is performed as described above, the determination as to whether or not the application step may be finished is made (step S4). If the application step may not be finished, the flow retunes to step S3, and the application operation is repeated until the application step is completed on all the area that requires the application of the application medium. On the other hand, after the application step is finished in step S4, the application roller 1001 is stopped (step S5). Thereafter, post-processing, which includes a collection operation for collecting the application liquid in the application space S and the liquid channel, is performed (step 6). Here, the processing relating to the application is ended.

Note that the above collection operation is performed in a manner that, by opening the atmosphere communication valves 3005 and the switching valve 3006, and additionally driving the pump 3007, the application liquid in the liquid retention space S and the second channel 3002 is caused to flow into the liquid storage tank 3003. By carrying out this collection operation, vaporization of the application liquid from the liquid retention space S can be reduced. Additionally, after the collection operation, the atmosphere communication valve 3005 is closed, and the communication between the first channel 3001 and the atmosphere communication port 3013 is blocked by switching the switching valve 3006, so that the storage tank 3003 is cut off from the atmosphere. As a result, while the vaporization of the application liquid from the storage tank 3003 can be reduced, the flowing-out of the application liquid can be at least reduced or completely prevented even if the device is inclined during the transferring or the carrying thereof.

Once the post-processing in step S6 is finished, information on the time when the post-processing is finished is stored. Here, the time when the post-processing is finished is a time when the pomp is stopped. That is, when the post-processing is finished, the CPU 4001 reads from the timer system 4012, and stores, in the nonvolatile memory 4013, information on the time when the above collection operation, that is, the latest liquid flowing operation (circulation operation), is finished. Since the timer system 4012 has the built-in battery, it can perform timing by receiving a power supply from the above built-in battery, even after the power supply thereof has been stopped.

Note that the time when the above collection operation is finished may be a clock time, or may be a lapse of time after a certain reference point (difference of times).

As has been described above, in the liquid application device in this embodiment, with the rotation of the application roller 1001, the application liquid filled into the liquid retention space S overcomes the pressing force of the lower edge portion 2011 of the contact member 2009 against the application roller 1001, and passes through to the outside of the liquid retention space S. This application liquid having passed through to the outside is supplied to the outer circumferential surface of the application roller 1001 forming a layer. The thickness of this application liquid, i.e., the amount of the application liquid supplied to the application roller 1001 depends on: viscosity of the application liquid; the relative speed between the outer circumferential surface of the application roller 1001, and the medium; the pressing force of the contact member 2009 against the outer circumferential surface of the application roller 1001; and the like.

In this embodiment, a preliminary circulation is performed in order to remove the harmful effects derived from the vaporization of the liquid. Here, when the liquid vaporizes in this embodiment will be described. Joining portions among the respective parts used in this embodiment, and tubes used for the respective channels 3001 and 3002, cannot perfectly keep air in a hermetically sealed state. Consequently, the liquid vaporizes from those parts although the vaporization progresses very little by little. For example, during a period between the filling operation by the preliminary circulation step, and the collection operation by the post-processing step, the application liquid (reactor) in each of the channels 3001 and 3002 is increasingly thickening. When the liquid has thickened, it turns into a pasty state (also referred to as a thickened matter), or generates a solid matter (also referred to as a sticking matter) resulting from solidification of the liquid. The liquid having turned into the pasty state has a high viscosity than the liquid in a normal state, thereby becoming a factor in hindering flow of the liquid in the channels when the liquid is filled therein next time.

Additionally, in some occasions, the liquid left uncollected in the post-processing remains in the channels 3001 and 3002 each having a complicated mechanism. The liquid thus remaining in an internal supply path or in the pump undergoes vaporization until the liquid is filled by the filling operation in a subsequent preliminary circulation step. The liquid in a pasty state hinders the flowing of the liquid when the liquid is filled again. Moreover, if the thickened liquid exists in the nip area between the application roller 1001 and the counter roller 1002, differences are generated in thickness of the liquid which passes through the above nip area. Thereby, application nonuniformity is caused.

Note that, in this Description, "thickening of liquid" means that the viscosity of the liquid with a predetermined composition existing in the parts other than the liquid storage tank becomes higher than the viscosity of the liquid contained in the liquid holding tank as a result of including substances, as in pasty, gel, solid and other states, whose viscosities become higher than the liquid through evaporation of a solvent, water or the like from the liquid with the predetermined composition. "Thickening of liquid" further means a state where the viscosity of the liquid is made higher by the reduction in temperature, and a state, derived from a difference in coagulation point, where one of the components of the liquid, each of which has a different coagulation point from those of others, is coagulated around the coagulation point of the component. That is, "thickening of liquid" implies that, on sidewalls of a collection path and the supply path, inside the switching valve, on a sidewall of the liquid retention member, inside the pump, and the like, the liquid turns into a state where the liquid becomes difficult to flow in the above passages. Additionally, "thickened liquid" includes: a state where at least any one of the thickened matter and the sticking matter is dispersed in the liquid; and a state where the liquid, and at least any one of the thickened matter and the sticking matter, are phase-separated.

While the "thickened matter" indicates one formed of the liquid thickened and turned into the pasty or gel state, and the "sticking matter" indicates one with a viscosity further increased from the viscosity of a thickened matter. That is, the thickened matter and the sticking matter both perform the function of hindering the flow of the liquid by, for example, blocking at least part of the each passage, and these matters are products formed of the liquid and having a higher viscosity than the liquid.

The thickened matter and the sticking matter become mixed with the liquid when they have been blended together for a certain length of time after the refilling of the liquid. With this property taken into account, the harmful effects of the thickening of the application liquid caused by the vaporization are avoided in this embodiment by performing the preliminary circulation in accordance with the lapse of time after the previous liquid flowing operation (also referred to as the "latest circulation operation"). The preliminary circulation operation is a circulation operation having a purpose different from purposes of the conventional filling operation, the circulation operation performed in each of, or between the application operations, and the collection operation. That is, the preliminary circulation is a circulation for making the viscosity of the application liquid, which has thickened due to generation of the thickened matter and the sticking matter, lower than the viscosities of the thickened matter and the sticking matter. In a conventional sequence from filling, to printing (application), and then to finishing, it is essential to supply a desired amount of the application liquid, and circulation of the liquid for that purpose is imperative. However, a sequence of the preliminary circulation in this embodiment is a circulation of the application liquid, performed for the purpose of maintaining reliability of the application liquid and thereby maintaining image quality of the prints. By circulating the application liquid, the preliminary circulation performs the functions of: mixing the thickened matter with the application liquid; and lowering the concentration of the application liquid having thickened, using the liquid before thickening.

Note that, in this Description, the "circulation operation" includes: a circulation operation for filling the application liquid into the liquid retention space S, the respective channels 3001 and 3002, the three-way valve 3006 and the pump 3007; and a circulation operation for collecting the application liquid to the ink storage tank 3003. The "circulation operation" also includes: a circulation operation performed during the application operation; circulation operations performed between operations of the filling, of the application and of the collection; and the preliminary circulation operation. Therefore, the latest circulation operation indicates the one precedes the current circulation operation in question.

In the present invention, the preliminary circulation of the application liquid is performed in accordance with the lapse of time after the previous circulation operation (the latest circulation operation), in order to reduce hindrance to the circulation of the application liquid, and also to reduce the application nonuniformity, which are derived from the thickened application liquid as has been described above.

FIG. 14 is a flow chart showing a procedure relating to the preliminary circulation step corresponding to step S1 of FIG. 13.

First of all, in step S21, the CPU 4001 obtains information concerning the lapse of time after the previous liquid flowing operation (previous circulation operation). That is, once an application start command is inputted, information indicating a current clock time is read out from the timer system 4012. Information indicating a time when the previous liquid flowing operation (the previous circulation operation) has been finished is also read out, the information being stored in the nonvolatile memory 4013. Then, the information indicating the lapse of time after the previous circulation operation is obtained based on these two pieces of information having been read out.

Subsequently in step S22, the CPU 4001 determines a preliminary circulation sequence based on the information indicating the lapse of time obtained in step S21. Finally in step S23, the preliminary circulation sequence is performed based on the preliminary circulation sequence determined in step S22.

The preliminary circulation sequence is determined in step S22 based on the lapse of time after the previous circulation operation. One example of a method for the determination is shown in FIG. 15. By referring to a table as shown in FIG. 15, the preliminary circulation sequence corresponding to the lapse of time after the previous circulation operation is determined. Specifically, any one of preliminary circulation sequences A to F is selected, the one corresponding to the time interval into which the obtained lapse of time falls, among predetermined time intervals P1 to P6 shown in FIG. 15 where $0 \leqq P1$ (seconds)$<P2$ (seconds), P2 (seconds)$\leqq P3$ (seconds)$<P4$ (seconds), P3 (seconds)$\leqq P4$ (seconds)$<P5$ (seconds), and P4 (seconds)$\leqq P5$ (seconds)$<P6$ (seconds).

These preliminary circulation sequences A to F are made different in circulation speed of the liquid. The longer the lapse of time after the previous circulation operation is, the higher the probability of having the application liquid sticking to passage walls becomes. In order to separate this sticking matter off from the passage walls, it is desired that the circulation speed of the liquid be made faster. Therefore, the circulation speeds of the liquid for the respective preliminary sequences are set faster with increasing length of the lapse of time. That is, the circulation speeds of the respective sequence are set beforehand in the order of "A<B<C<D<E<F".

Additionally, the preliminary circulation sequences A to F are not limited to the ones made different in circulation speed of the liquid. For example, they may be the ones made different in circulation period of the liquid. That is, the longer the circulation period of the liquid is, the more thickened matter and sticking matter, remaining in the flow channel, are mixed with the liquid currently circulating. In this regard, the circulation periods of the liquid is set longer with increasing length of the lapse of time. That is, the liquid circulation periods of the respective sequence are set beforehand in the order of "A<B<C<D<E<F".

Furthermore, the preliminary circulation sequences A to F may be the ones made different both in circulation speed of the liquid, and in circulation period of the liquid.

Thus in this embodiment, based on the lapse of time after the previous circulation operation, one preliminary circulation sequence is selected from among the different preliminary sequences of plural variations. Thereby, the preliminary circulation sequence comes to be selected in consideration of the lapse of time on which the thickening of the application liquid depends. Accordingly, the preliminary circulation matched with a degree of the thickening of the application liquid becomes possible. The method where the circulation speeds and the circulation periods in the respective preliminary circulation sequences A to F are made different can be realized, by controlling a rotation speed and a rotation period of the pump 3007, as shown in FIG. 16 for example. Since each of the preliminary circulation sequences A to F is set by changing the rotation speed and the rotation period of the pump 3007 as shown in FIG. 16, the amount of the application liquid used for the preliminary circulation can be optimized based on the obtained lapse of time. Therefore, unnecessary performance of the preliminary circulation is eliminated, whereby a cost decrease is also brought about.

As has been described above, according to this embodiment, even in a case where the application liquid in each of the portions has thickened or stuck due to the longer lapse of time after the previous circulation operation or the like, it becomes possible to smoothly perform a circulation of the application liquid into the liquid retention space from the storage tank without adding a large-scale device. Additionally, the thickening and sticking of the application liquid in each of the portions can be reduced. As a result, while quality of the application liquid can be maintained, the nonuniformity of application can be reduced. For this reason, the application of the application liquid to a medium always becomes uniform, a high-quality image always can be formed, and reliability of images can be maintained.

In particular, it becomes possible to reduce the viscosity of the application liquid having thickened or stuck by not being taken care of in each of the portions for a long time period, by performing the preliminary circulation sequence according to the lapse of tie after the previous circulation operation. More specifically, it becomes possible to make the viscosity of the application liquid in question closer to the viscosity of the application liquid stored in the storage tank.

Second Embodiment

In the first embodiment, the optimum preliminary circulation sequence is selected corresponding to the obtained lapse of time after the previous circulation operation. In addition to this, the optimum preliminary circulation sequence may be configured to be selected corresponding to a state of each of the portions at the start of the preliminary circulation after the lapse of time. In this embodiment, the preliminary circulation sequence is determined based not only on the lapse of time after the previous circulation operation, but also on whether or not there is the application liquid in the liquid retention space S at the start of the preliminary circulation.

Figure 17:
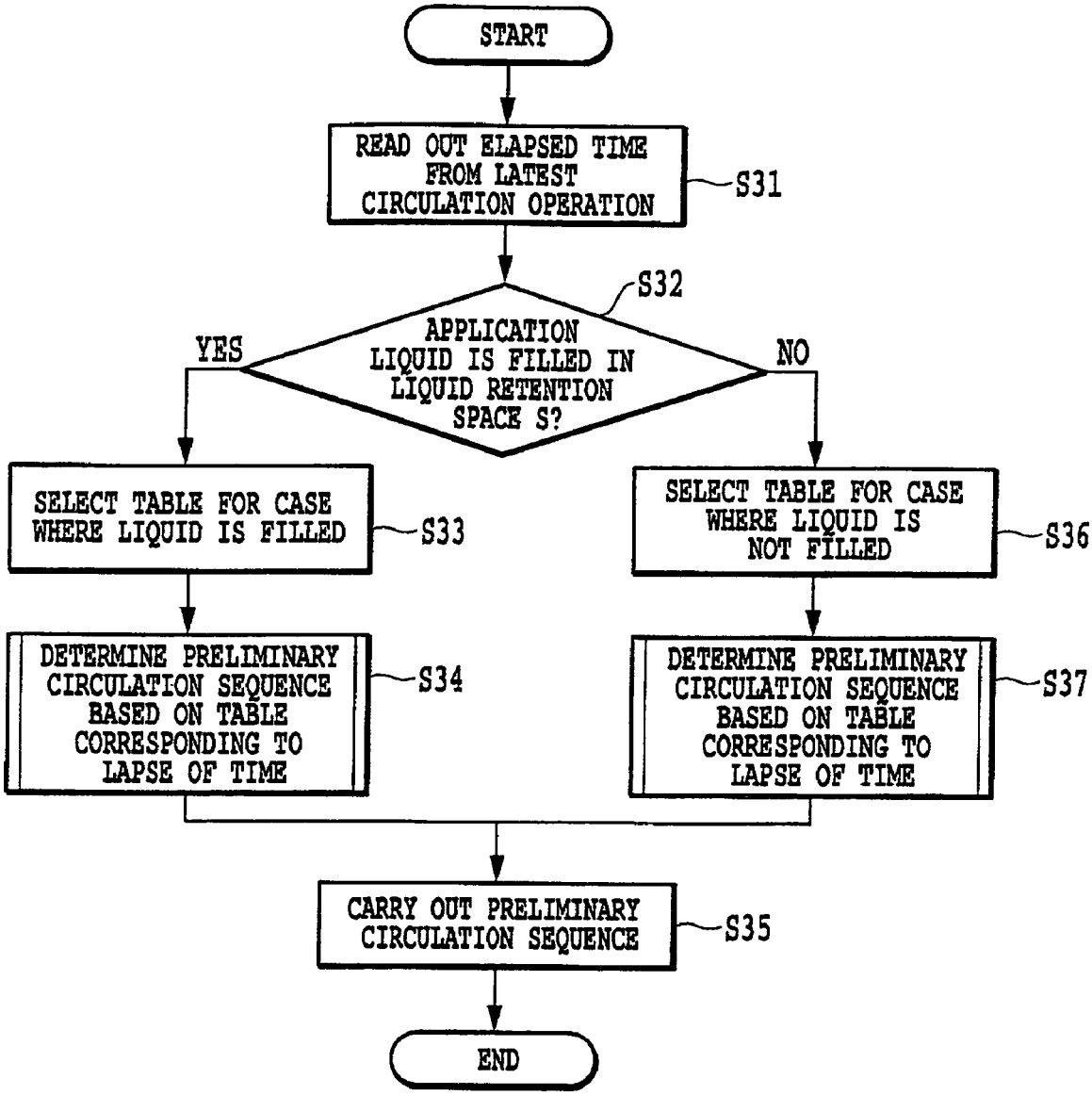
FIG. 17 is a flow chart showing the processing of the preliminary circulation operation according to the embodiment of the present invention.

FIG. 17, which is a flow chart showing a procedure relating to a preliminary circulation step according to the embodiment of the present invention, is a flow chart showing a procedure relating a preliminary circulation step corresponding to step S1 of FIG. 13.

In step S31, the CPU 4001 obtains information indicating the lapse of time after the previous circulation operation. That is, once the application start command is inputted, the CPU 4001 reads out information indicating the current clock time from the timer system 4012. Additionally, the CPU 4001 reads out information indicating the time when the previous circulation operation has been finished, the information being stored in the nonvolatile memory 4013. Then, the information indicating the lapse of time after the previous circulation operation is obtained based on these two pieces of information having been read out. Subsequently in step S32, judgment as to whether the application liquid is filled in the liquid retention space S is made by using a liquid detection sensor provided inside the liquid retention space S. In a case where the application liquid is filled in the liquid retention space S, the procedure advances to step S33. In step S33, a table 1 which is the table corresponding to cases where the application liquid is filled is selected, for example, in FIG. 18. On the basis of this, in step S34, by referring to FIG. 18, a preliminary circulation sequence is determined based on the lapse of time after the previous circulation operation. Subsequently, in step S35, the preliminary circulation sequence selected in step S34 is carried out.

In a case where it has been judged that the application liquid is not filled in the liquid retention space S, the procedure advances to step S36. In step S36, a table 2 which is the table corresponding to cases where the application liquid has is not filled is selected. On the basis of this, in step S37, by referring to FIG. 18, a preliminary circulation sequence is determined based on the lapse of time after the previous circulation operation. Subsequently, in step S35, the preliminary circulation sequence selected in step S37 is carried out.

As shown in FIG. 18, the tables for determining the preliminary sequence are configured to make it possible to select the optimum sequence based both on the lapse of time after the previous circulation operation, and on the situation with respect to presence or the absence of the application liquid inside the liquid retention space S. That is, the optimal preliminary circulation sequence is selected based both on a time interval, into which the obtained lapse of time falls, among predetermined time intervals P11 to P13, and on with whether or not the application liquid is filled inside the liquid retention space S. Here, the time interval P11 is expressed as "0<the lapse of time≦the upper limit value of the time interval P11". Additionally, the time interval P12 is expressed as "the upper limit value of the time interval P11<the lapse of time≦the upper limit value of the time interval P12". Moreover, the time interval P13 is expressed as "the upper limit value of the time interval P12<the lapse of time".

Note that, although this embodiment assumes a configuration where the lapse of time after the previous circulation operation and the presence or absence of the application liquid inside the liquid retention space S are used as the factors in determining the optimum preliminary circulation sequence, the present invention is not limited by this configuration. For example, the optimum preliminary circulation sequence may be configured to be determined based both on the lapse of time after the previous preliminary circulation, and on the temperature of the device. In this case, by configuring a temperature detection sensor provided inside the device to detect the temperature of the device, the preliminary circulation sequence may be selected based on the detected temperature.

On the other hand, while judgment on whether the application liquid is filled in the liquid retention space S is made by using the liquid detection sensor, the liquid detection sensor may be unnecessary in a case where this judgment can be made by using a manner other than the above.

Other Embodiments

Note that, in each of the above embodiments, the amount of the liquid that should be applied to the medium can be changed by changing the pressing force of the liquid retention member against the application roller by changing the elastic force of the spring member. Furthermore, the amount of the liquid that should be applied can be changed also by changing degrees of hardness of the liquid retention member, of the application roller, a roller supporting an endless belt, and the like.

Additionally, although the case where a coil spring as the spring member is used as the pressing means for pressing the liquid retention member against the application roller has been presented in each embodiment, the present invention is not limited by the case. As the above pressing means, another type of spring, for example, a plate spring can be used. Furthermore, an elastic material member such as the one of rubber can be used in stead of the spring member.

Moreover, numbers and forming positions of the liquid supply ports and the liquid collection ports formed in the liquid retention member are not limited by the above embodiments. For example, with the liquid supply ports being arranged in both end portions of the inside of the liquid retention space, at least one liquid collection port may be arranged between the liquid supply ports. Alternatively, with the liquid collection ports arranged in both end portions of the inside of the liquid retention space, at least one liquid supply port may be arranged between the liquid collection ports. What is essential here is that the liquid retained inside the liquid supply member is capable of flowing in the liquid retention space.

Furthermore, although the case where the counter roller is provided so as to face the application roller or the endless belt has been presented in each of the above embodiments, the present invention is not limited by the case. That is, a transferring force of the application roller or the endless belt is allowed to be conveyed to the medium by providing, instead of the counter roller, a supporting member formed of a plate material or the like, and by configuring an application member to be held between this plate material and the application roller. In this case, it is necessary that a surface of the supporting member, by which it makes contact with the medium, be configured to be a surface having a low friction coefficient, and a small surface energy.

(Embodiment of an Inkjet Recording Apparatus)

The liquid application devices shown in the first and second embodiments are effective when applied to inkjet recording apparatuses. Description will be given below of the case where the liquid application device described above is applied to an inkjet recording apparatus. However, since the application operation control described in connection with the first and second embodiments is applied similarly, the description thereof will be omitted.

Figure 20:
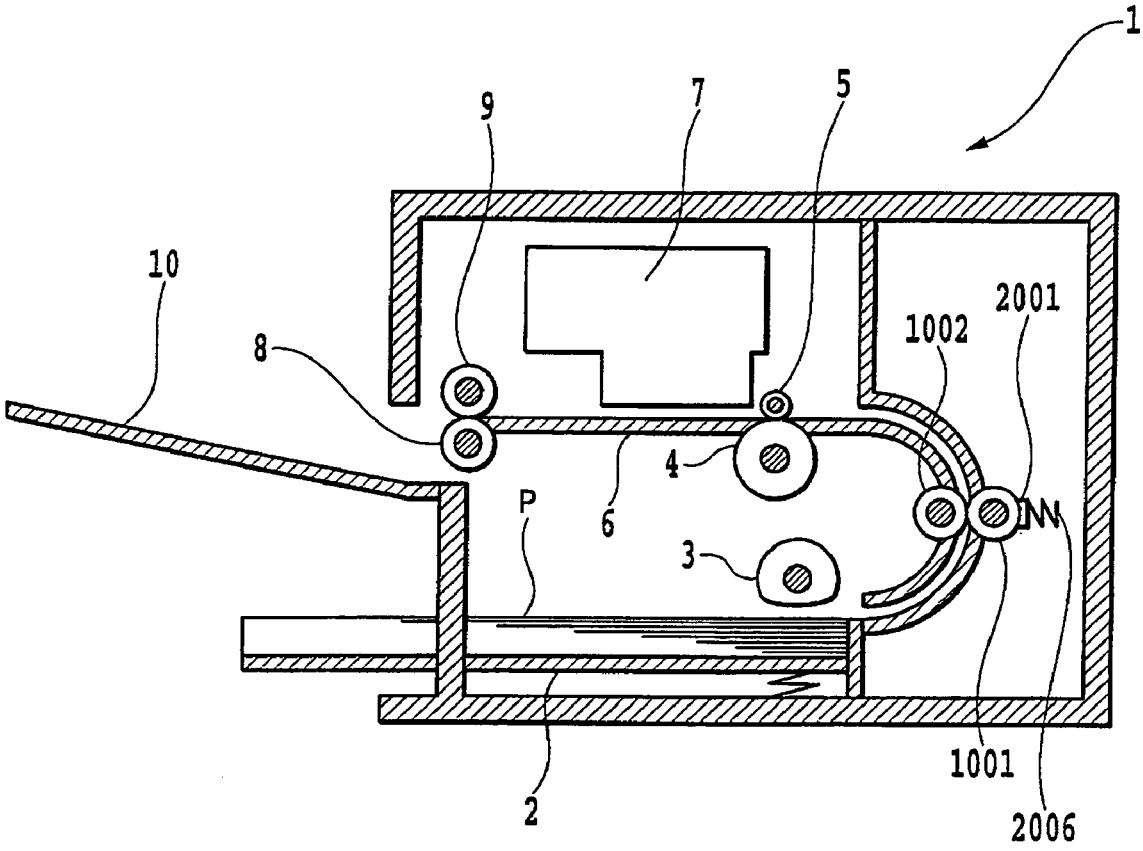
FIG. 20 is a longitudinal sectional side view showing a schematic configuration of an inkjet recording apparatus in an embodiment of the present invention.

FIG. 20 is a diagram showing a schematic configuration of the inkjet recording apparatus 1 including the application mechanism having almost the same configuration as that of the above liquid application device.

In the inkjet recording apparatus 1, provided is a feed tray 2 on which a plurality of recording media P are stacked, and a semi lunar shaped separation roller 3 separates the recording media P stacked on the feed tray one by one, and feeds each medium to a transfer path. In the transfer path, the application roller 1001 and the counter roller 1002 constituting the liquid application means of the liquid application mechanism are disposed. The recording medium P fed from the feed tray 2 is transferred to the interface between the rollers 1001 and 1002. The application roller 1001 is caused to rotate clockwise in FIG. 20 by the rotation of the roller drive motor, and applies the application liquid on the recording surface of the recording medium P while transferring the recording medium P. The recording medium P to which the application liquid has been applied is sent to the interface between a transfer roller 4 and a pinch roller 5. Subsequently, the counterclockwise (in this figure) rotation of the transfer roller 4 transfers the recording medium P on a platen 6, and moves the medium to a position facing a recording head 7 being an element of recording means. The recording head 7 is an inkjet recording head in which the predetermined number of nozzles for ejecting ink are arranged. While the recording head 7 scans the recording surface in a direction perpendicular to the plane of the drawing sheet, ink droplets are ejected from the nozzles to the recording surface of the recording medium P in accordance with the recorded data to perform recording. An image is formed on the recording medium while the recording operation and the transfer operation by a predetermined feed carried out by the transfer roller 4 are alternately repeated. With the image forming operation, the recording medium P is held between a sheet discharging roller 8 and a sheet discharging spur roller 9 provided downstream of the scanning region of the recording head in the transfer path of the recording media, and is discharged onto a sheet discharged tray 10 by the rotation of the sheet discharging roller 8.

As the inkjet recording apparatus, a so-called full-line type inkjet recording apparatus can be constructed, which performs the recording operation by using a long recording head which has ink-discharging nozzles arranged across the maximum width of the recording media.

The application liquid used in this embodiment is a treatment liquid for promoting the coagulation of pigment when the recording is carried out using an ink which contains pigment as a coloring material. With regard to this embodiment, the treatment liquid is used as the application liquid, so that the treatment liquid is allowed to react with the pigment as a coloring material in the ink ejected to the recording medium, to which the treatment liquid has been applied, to promote the coagulation of pigment. By this insolubility, it is made possible to achieve the improvement of the recording density. In addition, it is also made possible to reduce or prevent bleeding. Needless to say, the application liquid used in the inkjet recording apparatus is not limited to the above example.

Figure 21:
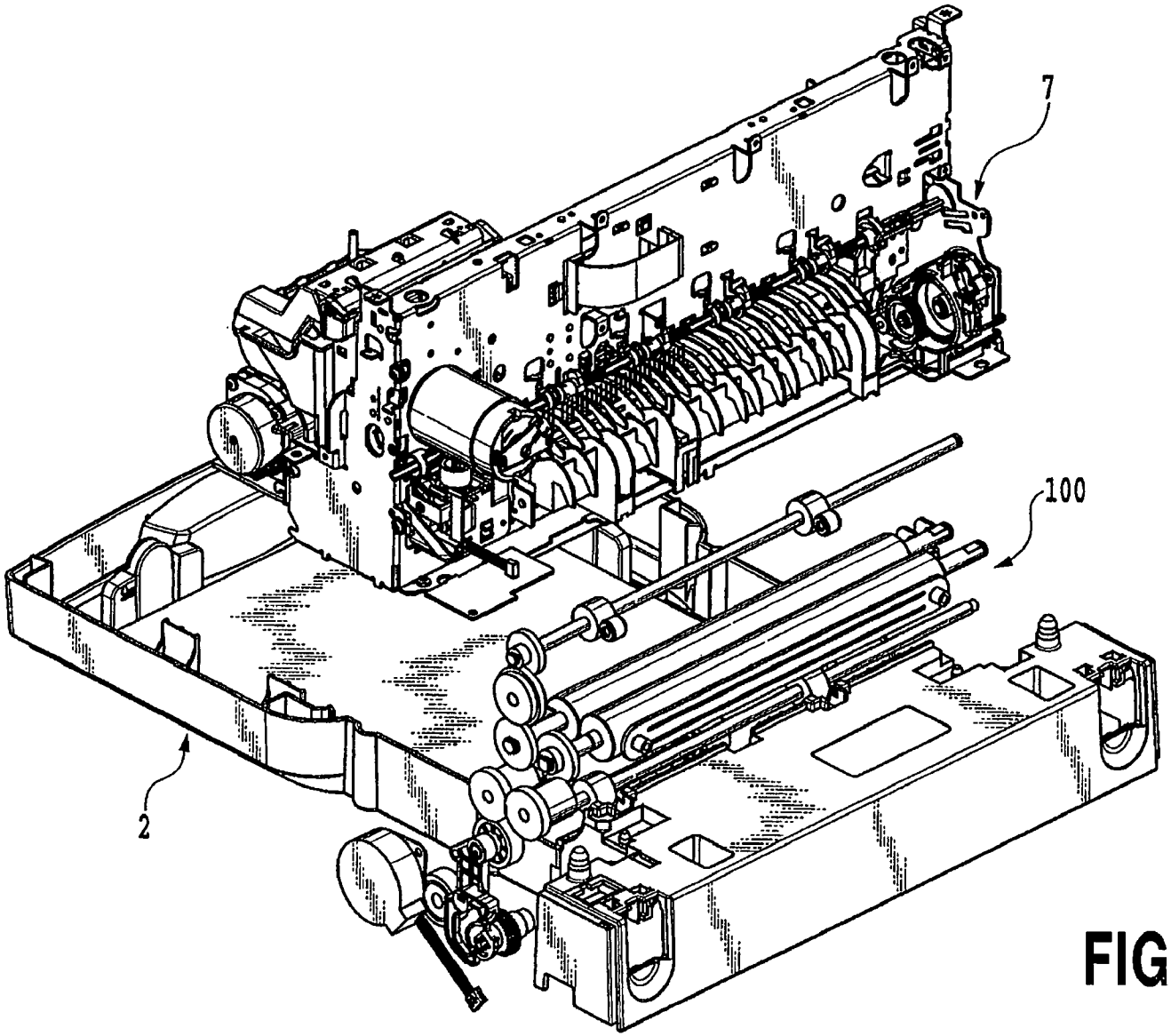
FIG. 21 is a perspective view showing a main part of the inkjet recording apparatus shown in FIG. 20.
Figure 22:
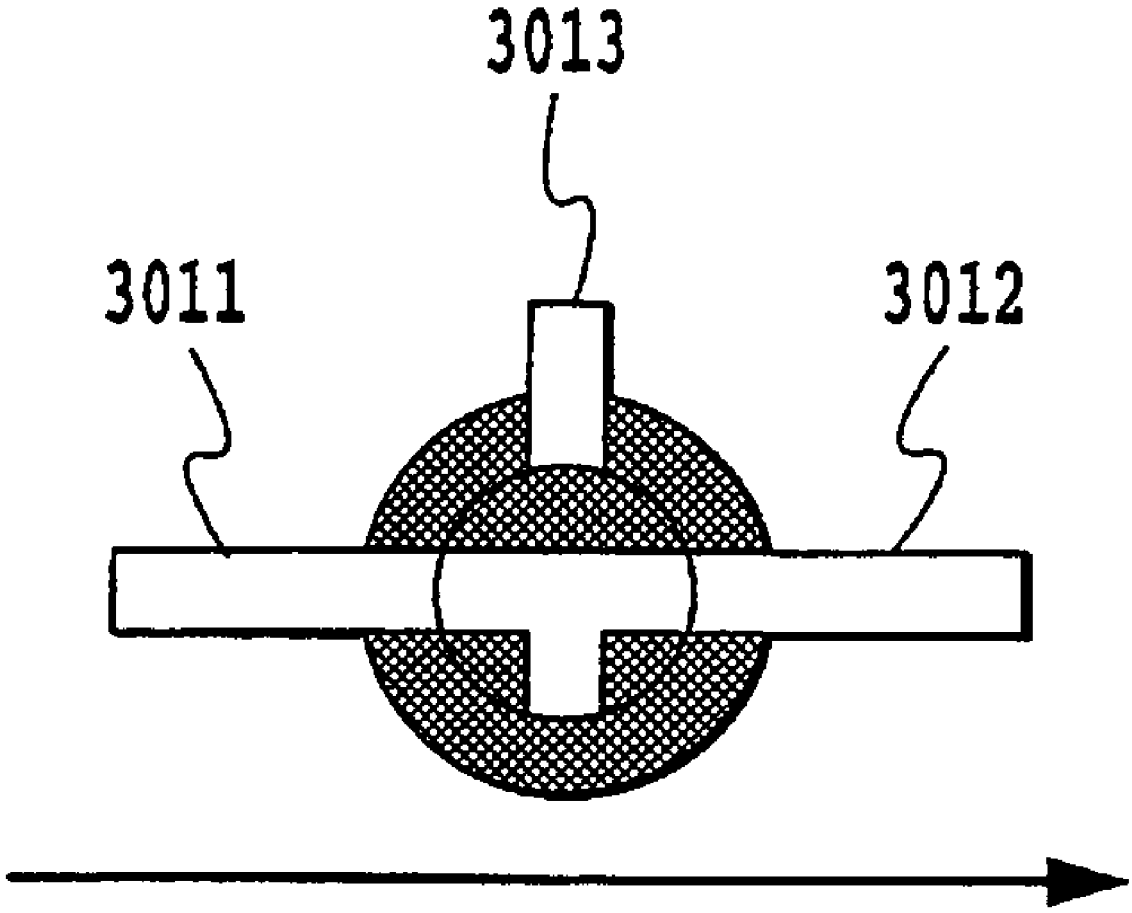
FIGS. 22 and 23 are diagrams for explaining a three-way valve in the embodiment of the present invention.
Figure 23:
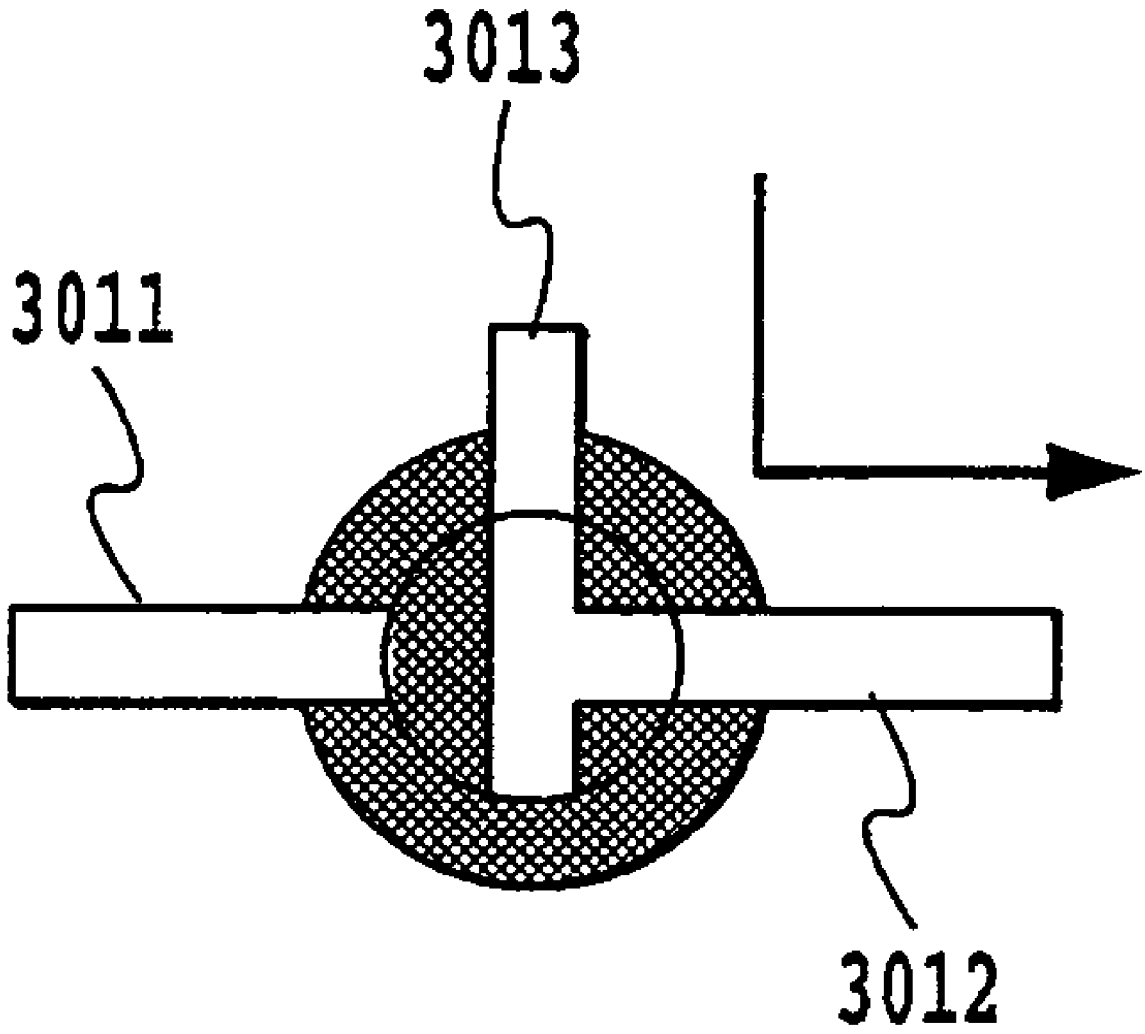

FIG. 21 is a perspective view showing a main part of the above-described inkjet recording apparatus. As shown in this figure, an application mechanism 100 is provided above an edge of the feed tray 2, and the recording means including the recording head 7 is provided above the application mechanism and over a middle portion of the feed tray 2.

Figure 27:
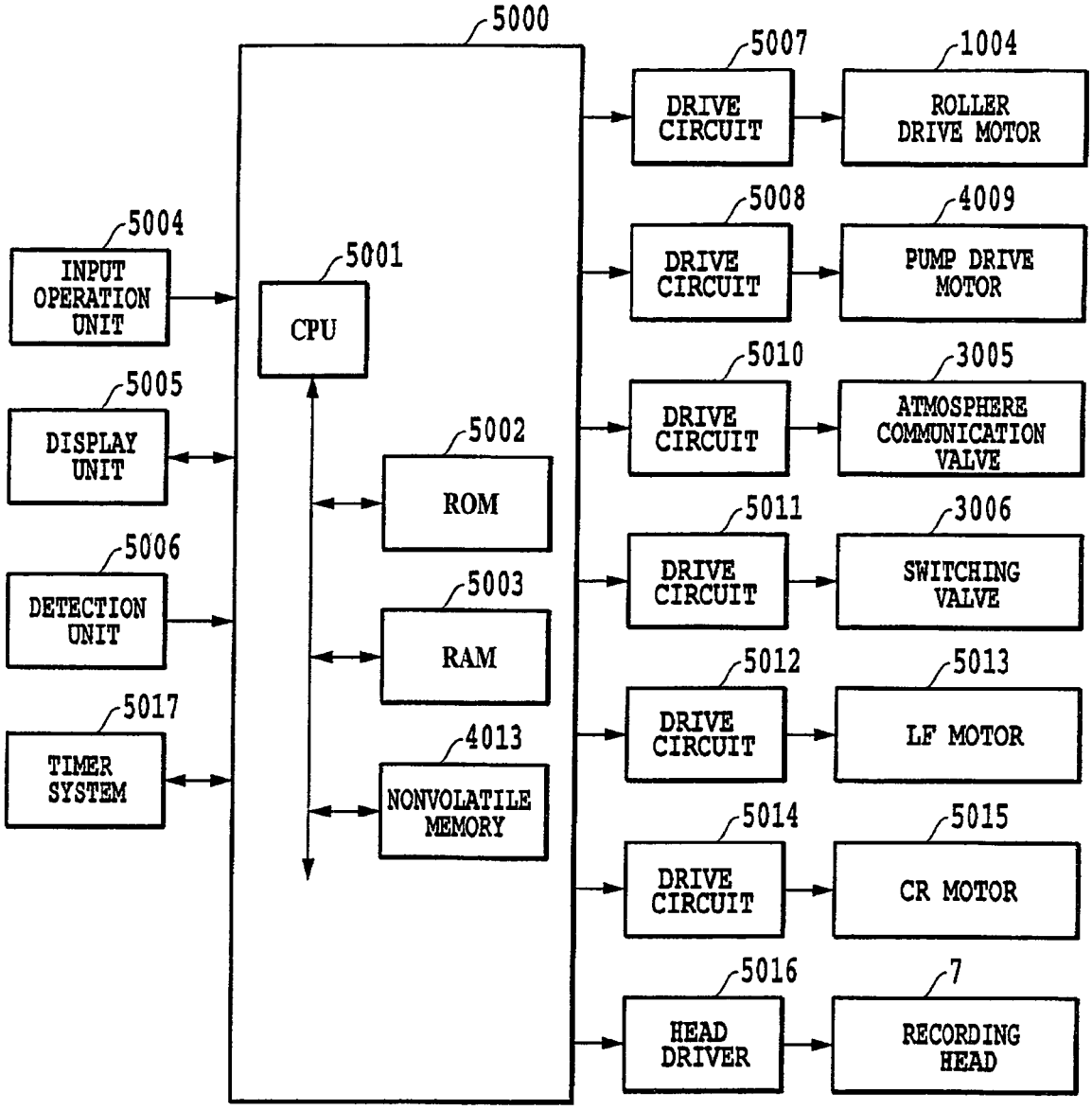
FIG. 27 is a block diagram showing a schematic configuration of a control system of the inkjet recording apparatus according to the embodiment of the present invention.

FIG. 27 is a block diagram showing a control system of the above-described inkjet recording apparatus. In this figure, the roller drive motor 1004, the pump drive motor 4009, and the atmosphere communication valve 3005, which are elements of the liquid application mechanism, are the same elements as those described in connection with the above liquid application device.

A CPU 5001 controls the driving of each element of the application mechanism in accordance with the program of a procedure described later in connection with FIG. 28. The CPU 5001 also controls the driving of an LF motor 5013, a CR motor 5015 and the recording head 7, which are included in the recording means, via drive circuits 5012, 5014 and 5016, respectively. Specifically, the transfer roller 4, for example, is rotated by the driving of the LF motor 5013, and a carriage on which the recording head 7 is mounted is moved by the driving of the CR motor. The CPU 5001 also effects control of the ink discharge from the nozzles of the recording head.

Figure 28:
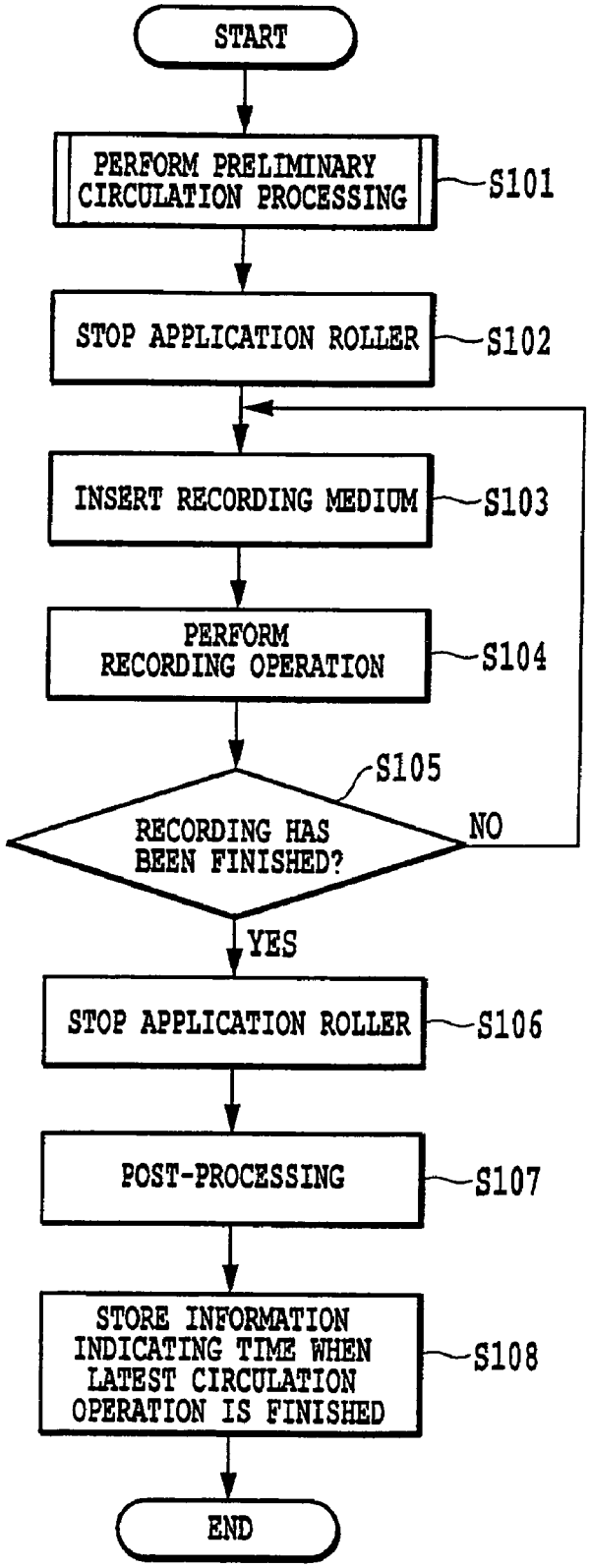
FIG. 28 is a flow chart showing a sequence of a recording operation in the inkjet recording apparatus in still another embodiment of the present invention.

FIG. 28 is a flow chart showing a procedure of the liquid application operation and the accompanying recording operation using the inkjet recording apparatus of this embodiment. In this figure, the processes in steps S101, S102, S104 to S106, and steps S109 to S112 are the same as those in steps S1, S2, S4 to S6, and steps S8 to S11, respectively, shown in FIG. 13.

As shown in FIG. 28, in this embodiment, when a command to start the recording is inputted in the recording apparatus, processing of the preliminary circulation is performed (step S101), and a series of steps of the liquid application operation, which include rotation of the application roller, are performed (steps S102 and S103). Thereafter, the liquid is applied onto the recording medium.

Onto the recording medium to which the application liquid has been thus applied, the recording operation is performed (step S104). Specifically, dots are formed in a manner that: the recording head 7 is caused to scan the recording medium P fed by a predetermined amount each time by the transfer roller 4; and the ink is allowed to adhere to the recording medium by ejecting the ink from the nozzles based on the recorded data during this scanning. Since this adhering ink reacts with the application liquid, it becomes possible to improve density and to reduce bleeding. Recording onto the recording medium P is performed by repeating the transfer of the recording medium and the scanning of the recording head, and the recording medium onto which the recording has been finished is delivered onto the delivery tray 10. If it is judged in step S105 that the recording has been finished, the application roller is stopped (S106), and post-processing including the collection operation for collecting the application liquid inside the application space Sand the liquid passages is performed (step S7).

Once the post-processing in step S107 is finished, information indicating a time when the post-processing has been finished is stored. That is, once the post-processing is finished, the CPU 5001 reads out, from the timer system 5017, the information indicating a time when the above collection operation corresponding to the latest liquid flowing operation (circulation operation) is finished. Then the CPU 5001 stores the information in the nonvolatile memory 5018. Because the timer system 5017 has the built-in battery, it can perform timing by receiving a power supplied from the above built-in battery even after a power supply of the apparatus has been stopped. By this step, the processing of FIG. 28 is ended.

Although this embodiment assumes a configuration where the recording operation is performed after the completion of application of the application liquid onto one recording medium, the present invention is not limited to this configuration. For example, the present invention may assume a configuration where, along with the liquid application onto a recording medium, printing is sequentially performed onto parts for which the application has been finished. That is, in a case where a length of the transfer path reaching the recording head from the application roller is shorter than a length of the recording medium, when a part of the recording medium onto which part the liquid has been applied is arrived at the scanning region of the recording head, the application is performed onto another part of the recording medium by the application mechanism. According to this configuration, the liquid application and the recording are sequentially performed on a part every time a predetermined amount of the recording medium is transferred, and are repeated onto different parts on the recording medium.

Additionally, in the recording apparatus of the present invention, it is possible to improve the whiteness of the medium by applying a liquid containing a fluorescent whitening agent to the recording medium. In this case, the recording means used after the application of the liquid is not limited to that of the inkjet type. The effect can be obtained also by adopting the means of other recording types, such as the thermal-transfer type and the electrophotographic type.

In addition, as the application liquid, a photosensitizing agent may be applied before recording in the recording apparatus of a silver-halide photographic type.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-235403, filed Aug. 15, 2005, which is hereby incorporated by reference herein in its entirety.

What is claimed is:

1. A liquid application device comprising:

a liquid application unit including an application member for applying liquid to a medium and a retention member for retaining the liquid in a liquid retention space formed in contact with the application member, wherein the liquid application unit applies the liquid retained in the liquid retention space to the medium via the application member by rotating the application member;

a storage unit configured to store the liquid;

a passage configured to cause the storage means and the retention member to communicate with each other;

a circulating unit configured to control a circulation operation for circulating the liquid in a channel including the storage unit, the passage, and the liquid retention space; and an obtaining unit configured to obtain information concerning lapse of time after a previous circulation operation by the circulating unit, wherein the circulating unit controls the circulation operation according to the information obtained by the obtaining unit.

2. The liquid application device according to claim 1, wherein, based on the information obtained by the obtaining unit, the circulating unit selects one circulation operation to be executed from a plurality of different circulation operations in which at least one of a circulation speed of the liquid and a circulation period of the liquid is different.

3. The liquid application device according to claim 1, further comprising a determination unit configured to determine the amount of the liquid necessary for the circulation operation, wherein the circulating unit controls the circulation operation depending on the amount determined by the determination unit.

4. The liquid application device according to claim 1, wherein the circulating unit includes a pump which generates a flow of the liquid in the channel.

5. A liquid application device comprising:

a liquid application unit including an application member for applying liquid to a medium and a retention member for retaining the liquid in a liquid retention space formed in contact with the application member, wherein the liquid application unit applies the liquid retained in the liquid retention space to the medium via the application member by rotating the application member;

a storage unit configured to store the liquid;

a passage configured to cause the storage unit and the retention member to communicate with each other; and a circulating unit configured to execute a circulation operation for circulating the liquid in a channel including the storage unit, the passage, and the liquid retention space, wherein the circulating unit increases a circulation period of a subsequent circulation operation, as a lapse of time after a previous circulation operation increases.

6. An inkjet recording apparatus comprising:

the liquid application device according to claim 1; and a recording unit configured to record an image on the medium by ejecting ink from a recording head to the medium to which the liquid has been applied by the liquid application device.

7. The inkjet recording apparatus according to claim 6, wherein the liquid includes a component which reacts with the ink.

8. A liquid application device comprising:

a liquid application unit including an application member for applying liquid to a medium and a retention member for retaining the liquid in a liquid retention space formed in contact with the application member, wherein the liquid application unit applies the liquid retained in the liquid retention space to the medium via the application member by rotating the application member;

a storage unit configured to store the liquid;

a passage configured to cause the storage means and the retention member to communicate with each other; and a circulating unit configured to execute a circulation operation for circulating the liquid in a channel including the storage unit, the passage, and the liquid retention space, wherein the circulating unit increases a circulation speed of a subsequent circulation operation as a lapse of time after a previous circulation operation increases.

9. An inkjet recording apparatus comprising:

a liquid application unit including an application roller for applying a liquid which reacts with an ink to a medium and a retention member for retaining the liquid in a liquid retention space formed in contact with the application member, wherein the liquid application unit applies the liquid retained in the liquid retention space to the medium via the application member by rotating the application roller;

a recording head configured to eject the ink to the medium to which the liquid has been applied by the liquid application unit;

a storage unit configured to store the liquid;

a passage configured to cause the storage unit and the retention member to communicate with each other;

a circulating unit configured to control a circulation operation for circulating the liquid in a channel including the storage unit, the passage, and the liquid retention space; and an obtaining unit configured to obtain information concerning a lapse of time after a previous circulation operation by the circulating unit, wherein the circulating unit controls at least one of a circulation speed and a circulation period of the circulation operation according to the information obtained by the obtaining unit.

* * * * *